US011787210B2

(12) United States Patent
Kobayashi et al.

(10) Patent No.: US 11,787,210 B2
(45) Date of Patent: Oct. 17, 2023

(54) PRINTING SYSTEM, TREATMENT APPARATUS, AND METHOD OF REUSING CLEANING LIQUID

(71) Applicant: SEIKO EPSON CORPORATION, Tokyo (JP)

(72) Inventors: Satoru Kobayashi, Shiojiri (JP); Shigenori Nakagawa, Tatsuno-machi (JP); Shin Komatsu, Shiojiri (JP); Yoshitaka Miyajima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 79 days.

(21) Appl. No.: 17/534,543

(22) Filed: Nov. 24, 2021

(65) Prior Publication Data

US 2022/0161581 A1 May 26, 2022

(30) Foreign Application Priority Data

Nov. 24, 2020 (JP) ..... 2020-194444

(51) Int. Cl.
*B41J 29/17* (2006.01)

(52) U.S. Cl.
CPC ..... *B41J 29/17* (2013.01)

(58) Field of Classification Search
CPC .... B41J 29/17; B41J 11/0015; B41M 5/0011; B41M 5/0017
See application file for complete search history.

(56) References Cited

U.S. PATENT DOCUMENTS

2008/0278538 A1* 11/2008 Tokuno ..... B41J 2/16541 347/33

FOREIGN PATENT DOCUMENTS

JP 2014034156 A 2/2014

* cited by examiner

*Primary Examiner* — Scott A Richmond
(74) *Attorney, Agent, or Firm* — CHIP LAW GROUP

(57) ABSTRACT

A printing system includes: a transport belt that configured to support and transport a medium, a liquid jetting unit configured to perform a printing operation by jetting a liquid to the medium, a storage tank that is an example of a cleaning liquid storage unit configured to store a cleaning liquid, a cleaning unit configured to perform a cleaning operation of the transporting belt using the cleaning liquid stored in the storage tank, a coagulation tank configured to store the cleaning liquid used for cleaning operation and to which a coagulating agent is added, and a separation unit configured to separate, from the cleaning liquid, a coagulated material produced by coagulation caused by adding the coagulating agent to the cleaning liquid. The cleaning liquid from which the coagulated material is separated by the separation unit is supplied to the storage tank.

11 Claims, 5 Drawing Sheets

PRINTING SYSTEM, TREATMENT APPARATUS, AND METHOD OF REUSING CLEANING LIQUID

The present application is based on, and claims priority from JP Application Serial Number 2020-194444, filed Nov. 24, 2020, the disclosure of which is hereby incorporated by reference herein in its entirety.

BACKGROUND

1. Technical Field

The present disclosure relates to a printing system configured to reuse a cleaning liquid used for cleaning a transporting belt that supports and transports a medium during a printing operation where printing is performed by jetting a liquid, a treatment apparatus configured to reuse the cleaning liquid, and a method of reusing the cleaning liquid.

2. Related Art

A droplet jetting apparatus disclosed in JP-A-2014-034156 includes a transporting belt configured to transport a medium, and a jetting head configured to jet a working liquid onto a transported medium in the form of droplets. The droplet jetting apparatus includes a removing unit configured to remove foreign materials such as ink, dust, lint, and the like sticking to the transporting belt using a cleaning liquid, and a waste liquid tank configured to collect the cleaning liquid discharged as a waste liquid after being used in the removing unit. The working liquid is an example of the liquid, the cleaning liquid is an example of the cleaning liquid, and the removing unit is an example of the cleaning unit.

In the droplet jetting apparatus disclosed in JP-A-2014-034156, the waste liquid collected in the waste liquid tank contains ink and hence, it is necessary to perform a waste liquid treatment. In an installation that includes a waste liquid treatment facility such as a factory, a droplet jetting apparatus is connected to a dedicated waste liquid treatment facility and hence, a waste liquid can be subjected to a waste liquid treatment. However, in an installation that does not include a waist liquid treatment facility such as an office, a user has to properly collect a waste liquid, and has to ask the treatment of the collected waste liquid to a waste liquid treatment dealer. Such an operation becomes cumbersome for the user.

SUMMARY

A printing system for solving the above-mentioned problems is a printing system including: a transporting belt configured to support and transport a medium, a liquid jetting unit configured to perform a printing operation by jetting a liquid to the medium, a cleaning liquid storage unit configured to store a cleaning liquid, a cleaning unit configured to perform a cleaning operation of the transporting belt using the cleaning liquid stored in the cleaning liquid storage unit, a coagulation tank configured to store the cleaning liquid to which a coagulating agent is added after the cleaning liquid is used in the cleaning operation, and a separation unit configured to separate a coagulated material, produced by coagulation caused by adding the coagulating agent to the cleaning liquid, from the cleaning liquid, wherein the cleaning liquid from which the coagulated material is separated by the separation unit is supplied to the cleaning liquid storage unit.

A treatment apparatus for solving the above-mentioned problems is a treatment apparatus for a printing apparatus that includes: a transporting belt configured to support and transport a medium, a liquid jetting unit configured to perform a printing operation by jetting a liquid to the medium, and a cleaning unit configured to perform a cleaning operation of the transporting belt, the treatment apparatus being configured to treat a cleaning liquid used in the cleaning operation of the transporting belt, wherein the treatment apparatus comprising: a collection flow path configured to collect the cleaning liquid used in the cleaning operation from the printing apparatus, a coagulation tank configured to store the cleaning liquid collected from the printing apparatus by the collection flow path and to which a coagulating agent is added after the cleaning liquid is used in the cleaning operation, a separation unit configured to separate a coagulated material, produced by coagulation caused by adding the coagulating agent to the cleaning liquid, from the cleaning liquid, and a supply flow path configured to supply the cleaning liquid from which the coagulated material is separated by the separation unit to the printing apparatus.

A printing system for solving the above-mentioned problems includes: a transporting belt configured to support and transport a medium, a liquid jetting unit configured to perform a printing operation by jetting a liquid onto the medium, a cleaning liquid storage unit configured to store a cleaning liquid, a cleaning unit configured to perform a cleaning operation of the transporting belt using the cleaning liquid stored in the cleaning liquid storage unit, a coagulation tank configured to store the cleaning liquid to which a pre-treatment agent is added after the cleaning liquid is used in the cleaning operation, and a separation unit configured to separate a coagulated material, produced by coagulation caused by adding the pre-treatment agent to the cleaning liquid, from the cleaning liquid, wherein the cleaning liquid from which the coagulated material is separated by the separation unit is supplied to the cleaning liquid storage unit.

A method of reusing a cleaning liquid for solving the above-mentioned problems is a method of reusing a cleaning liquid in a printing system that includes: a transporting belt configured to support and transport a medium, a liquid jetting unit configured to perform a printing operation by jetting a liquid to the medium, a cleaning liquid storage unit configured to store a cleaning liquid, a cleaning unit configured to perform a cleaning operation of the transporting belt using the cleaning liquid stored in the cleaning liquid storage unit, a coagulation tank configured to store the cleaning liquid to which a coagulating agent is added after the cleaning liquid is used in the cleaning operation, and a separation unit configured to separate a coagulated material, produced by coagulation caused by adding the coagulating agent to the cleaning liquid, from the cleaning liquid, wherein the method including:

performing a cleaning operation of the transporting belt using the cleaning liquid, performing coagulation by adding a coagulating agent to the cleaning liquid used in the cleaning operation, separating a coagulated material, produced by coagulation caused by adding the coagulating agent to the cleaning liquid from the cleaning liquid to which the coagulating agent is added, performing coagulation by adding a pre-treatment agent to the cleaning liquid used in the cleaning operation, and separating a coagulated material, produced by coagulation caused by adding the pre-treatment agent to the cleaning liquid, from the cleaning liquid to which the pre-treatment agent is added.

DESCRIPTION OF EXEMPLARY EMBODIMENTS

Figure 1:
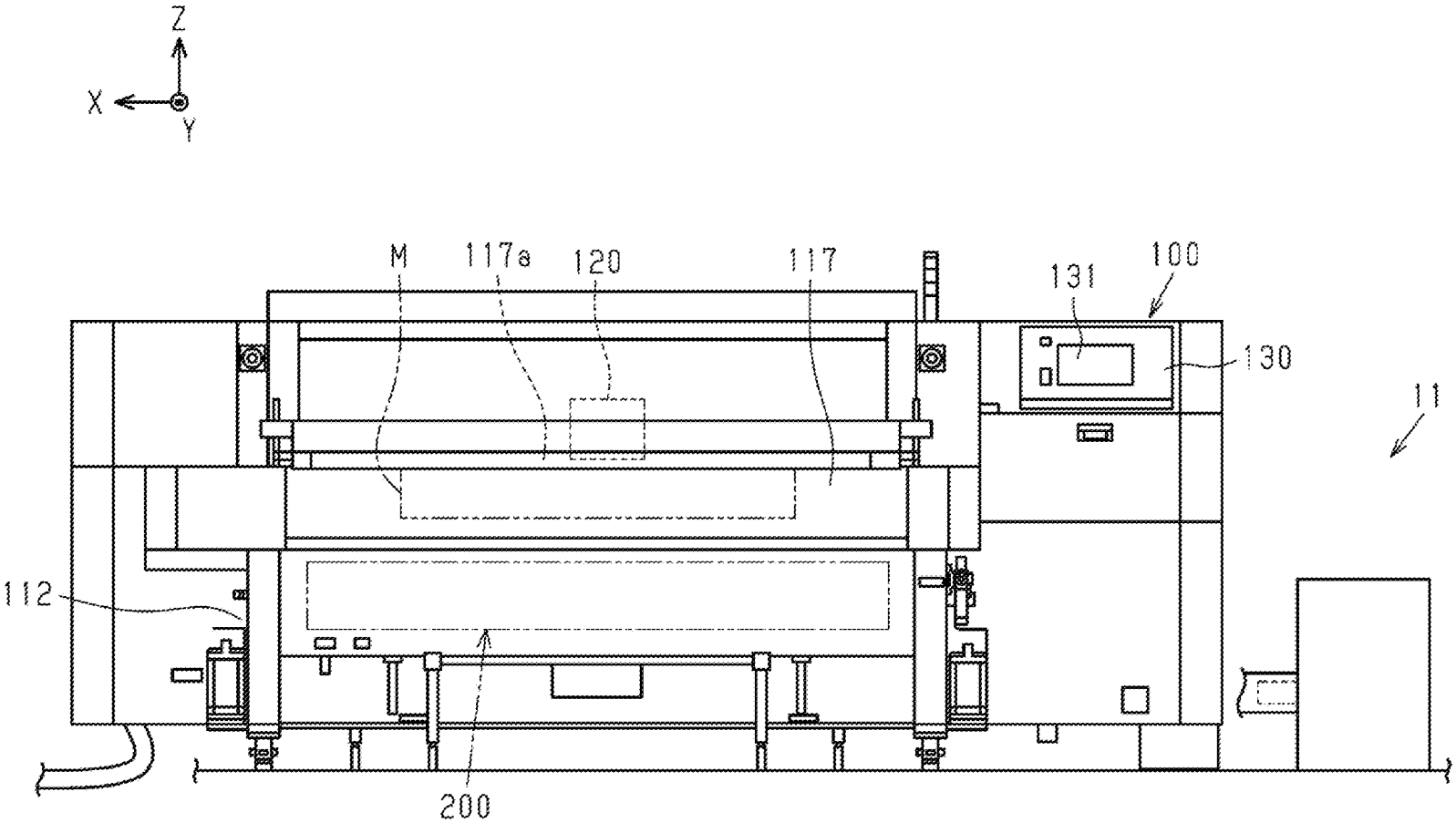
FIG. 1 is a front view illustrating a configuration of a printing system according to an embodiment.

Hereinafter, a printing system configured to reuse a cleaning liquid for cleaning a transporting belt, a treatment apparatus configured to reuse the cleaning liquid, and a method of reusing the cleaning liquid according to one embodiment are described with reference to drawings. For example, the printing system includes an ink-jet type printer configured to support a medium such as a fabric or a paper by a transporting belt, and to perform printing by jetting ink that is an example of a liquid to the medium.

In the drawing, assuming that a printing apparatus 100 is placed on a horizontal surface, the direction of gravity is indicated by a Z axis, and directions extending along the horizontal surface are indicated by an X axis and a Y axis respectively. The X axis, the Y axis, and the Z axis are orthogonal to each other. In the description made hereinafter, a direction extending along the X axis is also referred to as a width direction X, a direction extending along the Y axis is also referred to as a depth direction Y, and a direction extending along the Z axis is also referred to as a gravitational direction Z. In this case, when it is necessary to distinguish a "left side" and a "right side" from each other with respect to a width direction of the apparatus, the "left" is referred to as a +X direction, and the "right" is referred to as a −X direction. When it is necessary to distinguish a "front side" and a "depth side" from each other with respect to a depth direction of the apparatus, the "front side" is referred to as a +Y direction, and the "depth side" is referred to as a −Y direction. When it is necessary to distinguish an "upper side" and a "lower side" from each other with respect to a height direction of the apparatus, the "upper side" is referred to a as a +Z direction, and the "lower side" is referred to as a −Z direction.

A configuration of the printing system configured to reuse a cleaning liquid.

As illustrated in FIG. 1, a printing system 11 includes the printing apparatus 100, and a treatment apparatus 200. The printing apparatus 100 includes a glue belt 117 that is an example of a transporting belt configured to support and transport a medium M as a support unit 117*a*, and a liquid jetting unit 120 configured to perform a printing operation by jetting a liquid to the medium M supported by the glue belt 117.

The printing apparatus 100 includes a housing 112 having a columnar beam structure, and an operation unit 130. The treatment apparatus 200 is disposed inside the columnar beam structure of the housing 112 and below the glue belt 117. The operation unit 130 is operated by a user, and has a display unit 131 formed of a touch-panel-type liquid crystal screen or the like, and buttons for operations, for example. The operation unit 130 is configured to operate not only the printing apparatus 100 but also the treatment apparatus 200. That is, the printing system 11 includes the operation unit 130.

Figure 2:
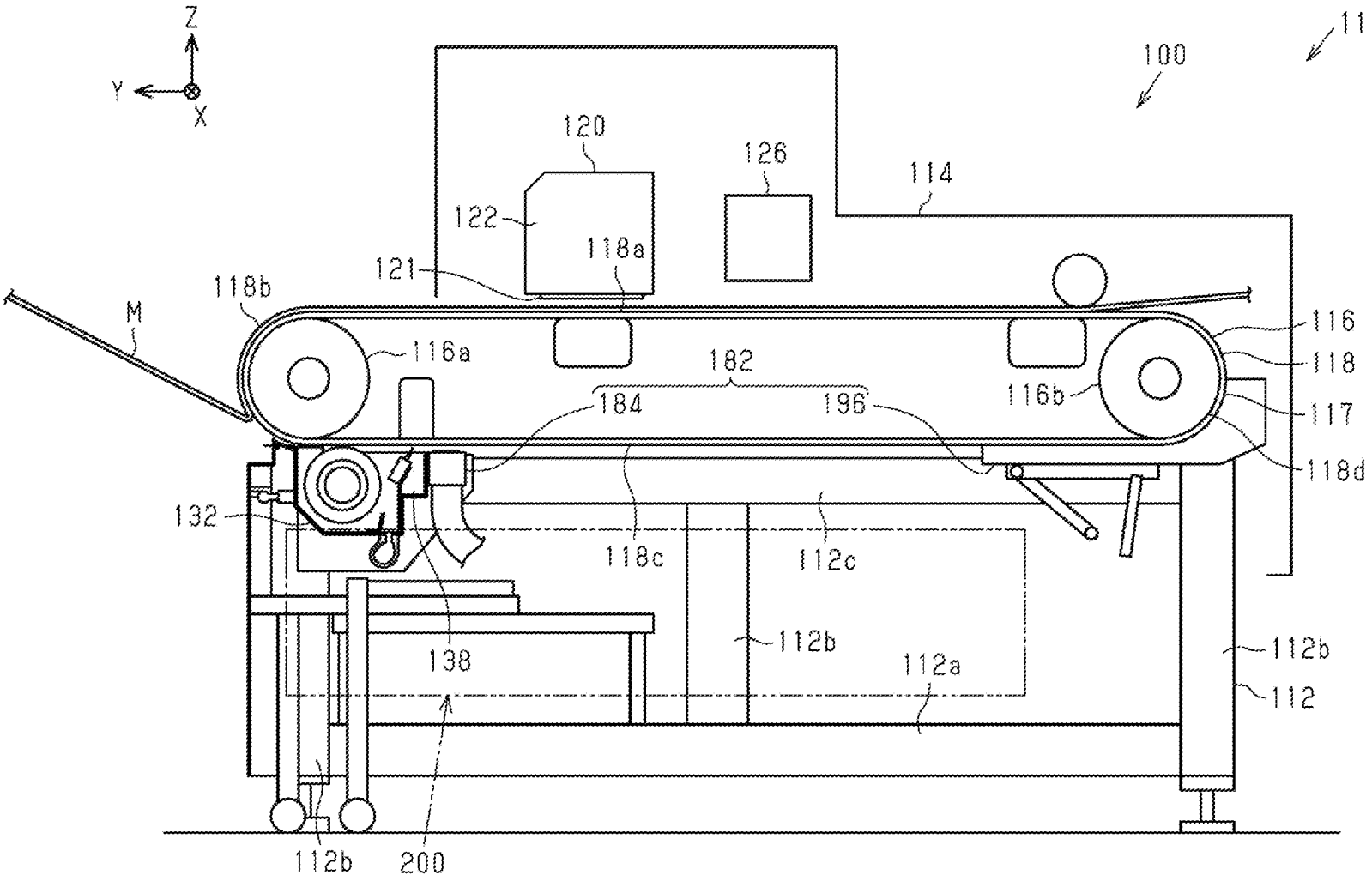
FIG. 2 is a cross-sectional side view illustrating an internal structure of the printing system illustrated in FIG. 1.

As illustrated in FIG. 2, the printing apparatus 100 includes a cover 114, a transport unit 116 configured to transport a medium by the glue belt 117, a printing apparatus control unit 126, a cleaning unit 132 and a drying unit 182.

The housing 112 is constituted as a base portion on which respective units of the printing apparatus 100 are mounted. The housing 112 adopts the columnar beam structure including a bottom frame 112*a*, column frames 112*b*, and an upper frame 112*c*. The cover 114 is an exterior member that covers the respective units of the printing apparatus 100.

As illustrated in FIG. 2, the transporting unit 116 is disposed on an upper portion of the housing 112, and the transporting unit 116 includes a drive roller 116*a*, a driven roller 116*b*, the glue belt 117, and a winding roller not illustrated in the drawing. The transport unit 116 is configured to transport the medium M in the +Y direction along with the movement of the glue belt 117 caused by rotation of the drive roller 116*a*. The drive roller 116*a* is disposed on a downstream side in the +Y direction, and the driven roller 116*b* is disposed on an upstream side in the +Y direction. Further, the drive roller 116*a* and the driven roller 116*b* each include a rotary shaft extending along the X direction. The transport unit 116 is controlled by the printing apparatus control unit 126 described later.

The glue belt 117 is constituted as an endless belt where both ends of a flat sheet having elasticity are joined to each other. The glue belt 117 is wound around an outer peripheral surface of the drive roller 116*a* and an outer peripheral surface of the driven roller 116*b*. That is, the glue belt 117 is mounted on the housing 112, and is configured to transport the medium M by being moved in a circulating manner.

For example, a surface 118 of the glue belt 117 has sticking property and hence, the surface 118 can support and stick the medium M thereon. Here, "sticking property" is a property that allows the surface 118 of the glue belt 117 to temporarily stick to other member, and allows the surface 118 of the glue belt 117 to be peeled off from a sticking state.

On the surface 118, a direction intersecting with the +Y direction that is a moving direction of the glue belt 117 becomes the X direction. A portion of the surface 118 that is positioned on a +Z direction side with respect to the center of the drive roller 116*a* and extends along an XY plane is set as an upper surface portion 118*a*. The upper surface portion 118*a* supports the medium M. Further, a portion of the surface 118 that is wound around the drive roller 116*a* is set as a curved surface portion 118*b*. Still further, a portion of the surface 118 that is positioned on a −Z direction side with respect to the center of the drive roller 116*a* and extends along the XY plane is set as a lower surface portion 118*c*. In addition, a portion of the surface 118 that is wound around the driven roller 116*b* is set as a curved surface portion 118*d*.

The transport unit 116 is configured to change a transport speed of the medium M by adjusting a rotational speed per unit time of the drive roller 116*a*. By allowing the wining roller not illustrated in the drawing to wind the medium M, the medium M is peeled off from the curved surface portion 118*b*.

As illustrated in FIG. 2, the liquid jetting unit 120 is disposed above the transport unit 116. The liquid jetting unit 120 is configured to enable recording on the medium M transported in the +Y direction. The liquid jetting unit 120 includes a liquid jetting head 121, and a carriage 122 configured to support the liquid jetting head 121 in a reciprocating manner along the X direction. The liquid jetting head 121 is disposed on a +Z direction side with respect to the medium M, and is configured to perform recording on the medium M by ejecting ink as an example of a liquid on a recording surface of the medium M. The liquid jetting unit 120 is controlled by the printing apparatus control unit 126.

The printing apparatus control unit 126 includes a CPU and a memory not illustrated in the drawing. The CPU is an arithmetic processing unit. The memory is a storage device for ensuring a region in which programs run by the CPU are stored, a working region for running the programs, or the like, and the memory includes a memory element such as a RAM and an EEPROM, a storage, and the like. The CPU is configured to control operations of the respective units of the printing apparatus 100 in accordance with the programs stored in the memory.

The cleaning unit 132 is configured to clean the surface 118 of the glue belt 117. The cleaning unit 132 is disposed on a −Z direction side with respect to an end portion of the lower surface portion 118*c* on a +Y direction side. The cleaning unit 132 is controlled by the printing apparatus control unit 126. The cleaning unit 132 is described in detail later.

The drying unit 182 is configured to dry the surface 118 that is cleaned by the cleaning unit 132. The drying unit 182 includes a blow-off unit 184 configured to blow off air toward the surface 118, and a heating unit 196 configured to heat the surface 118, for example. The blow-off unit 184 is disposed adjacent to the cleaning unit 132 at a position on a −Y direction side with respect to the cleaning unit 132. The heating unit 196 is disposed on a −Y direction side with respect to an end portion of the lower surface portion 118*c* on a −Y direction side. The drying unit 182 is controlled by the printing apparatus control unit 126.

Figure 3:
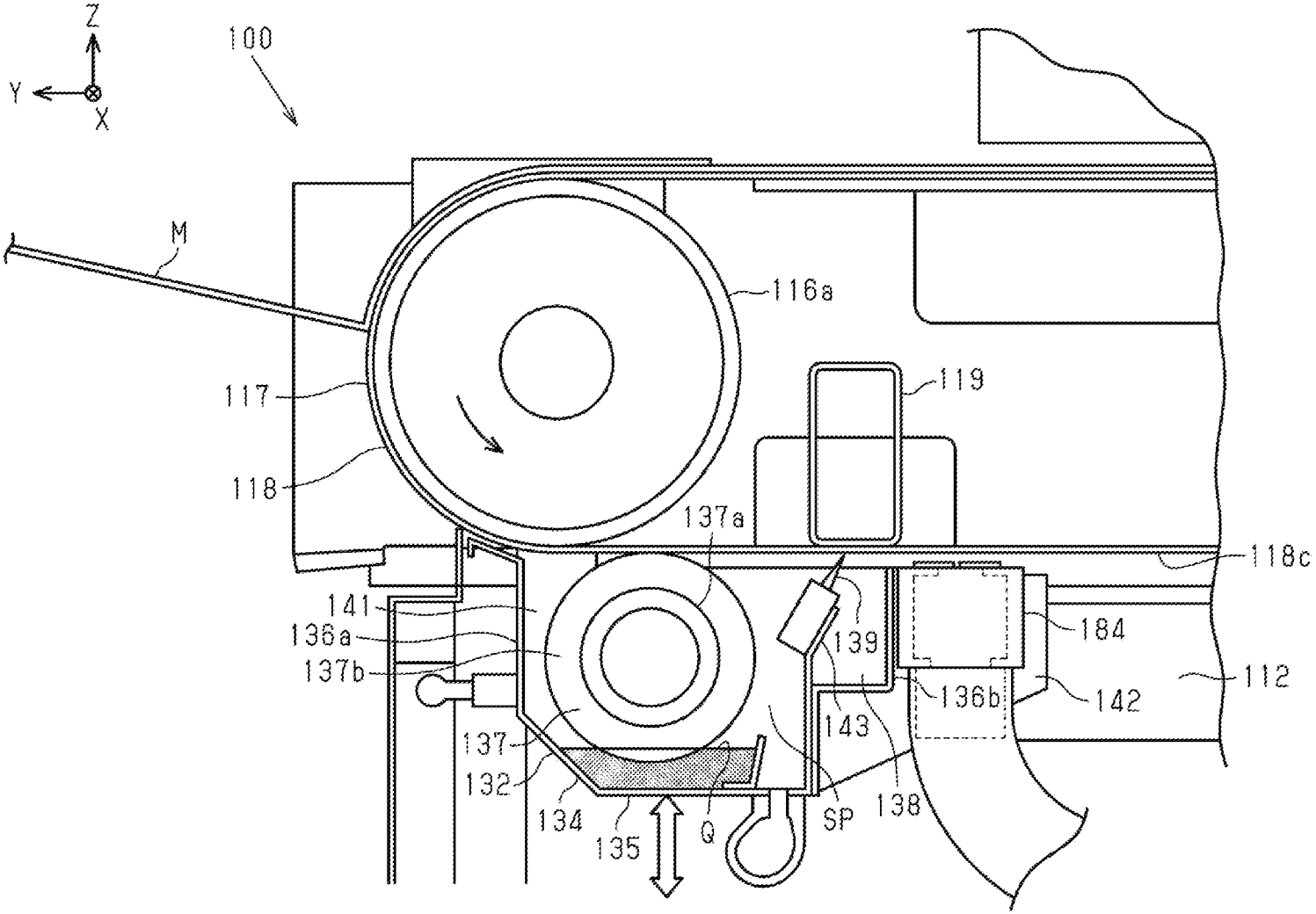
FIG. 3 is a cross-sectional side view illustrating a cleaning unit that the printing system illustrated in FIG. 3 includes.

As illustrated in FIG. 3, the cleaning unit 132 includes a storage tank 134 that is an example of a cleaning liquid storage unit for storing a cleaning liquid Q, a cleaning brush 137 that is an example of a cleaning unit, and a rubber blade 139. The cleaning unit 132 can be elevated and lowered in the Z direction with respect to the glue belt 117 to be cleaned using an air cylinder not illustrated in the drawing.

There may be a case where a liquid sticks to the surface 118 of the glue belt 117 as the liquid jetting unit 120 performs recording on the medium M. For example, when the medium M is a cloth, there may be a case where a liquid such as ink that penetrates the cloth from a front surface to a back surface sticks to the surface 118. Further, when the medium M is peeled off from the surface 118, lint of the cloth may remain on the surface 118. A liquid, such as ink sticking to the surface 118 smears the medium M, and the lint remaining on the surface 118 lowers a sticking force of the medium M to the surface 118. In the cleaning unit 132, to remove a liquid and lint produced attributed to a base material of a medium sticking to the surface 118, the surface 118 of the glue belt 117 is cleaned by the cleaning brush 137.

The storage tank 134 is disposed below the drive roller 116*a* and the glue belt 117. The storage tank 134 includes a bottom wall 135, a front wall 136*a*, a rear wall 136*b*, and a pair of side walls 138. The bottom wall 135 is formed into a rectangular plate shape having a predetermined thickness in the Z direction, and is disposed along an XY plane. The front wall 136*a* stands upright in the +Z direction at an end portion of the bottom wall 135 on a +Y direction side. The rear wall 136*b* stands upright in the +Z direction at an end portion of the bottom wall 135 on a −Y direction side. The pair of side walls 138 is respectively disposed at an end portion of the bottom wall 135 on a +X direction side and at an end portion of the bottom wall 135 on a −X direction side respectively one by one. The pair of side walls 138 stands upright in the +Z direction from the bottom wall 135. That is, the storage tank 134 has a box shape with an upper side thereof opened. The cleaning liquid Q for cleaning the surface 118 is stored in a space SP that is the box-shaped inside of the storage tank 134, and the spade SP is surrounded by the bottom wall 135, the front wall 136*a*, the rear wall 136*b* and the pair of side walls. That is, the storage tank 134 stores the cleaning liquid Q that is scheduled to be supplied to the cleaning brush 137 during a cleaning operation in the box-shaped inside of the storage tank 134 where the upper side is opened.

The side wall 138 extends in the −Y direction beyond the rear wall 136*b* as viewed in the X direction. That is, the side wall 138 has a side wall portion 141 that forms the space SP, and an extending portion 142 that extends from the side wall portion 141 in the −Y direction, and is positioned outside the space SP. The extending portion 142 supports the blow-off unit 184. That is, the blow-off unit 184 is supported by the cleaning unit 132.

The cleaning brush 137 has a shaft portion 137*a* having a circular cylindrical shape, and a brush portion 137*b* extending radially from an outer peripheral surface of the shaft portion 137*a*. The shaft portion 137*a* extends along the X direction, and is rotatably supported on a portion of the side wall 138.

The brush portion 137*b* is configured to be brought into contact with the lower surface portion 118*c*. When the cleaning brush 137 is rotated by a motor not illustrated in the drawing, a liquid and lint produced attributed to the medium base material sticking to the lower surface portion 118*c* are removed by the cleaning liquid Q stored in the storage tank 134. That is, the cleaning brush 137 performs a cleaning operation of the glue belt 117 using the cleaning liquid Q stored in the storage tank 134. The liquid and the lint produced attributed to the medium base material removed from the glue belt 117 by the cleaning brush 137 are collected in the form that the liquid and the lint are mixed into the cleaning liquid Q in the storage tank 134.

The rubber blade 139 is mounted on a plate-like portion 143 that extends in the +Z direction from a portion of the rear wall 136*b*, and scrapes down the cleaning liquid Q and the like remaining on the lower face portion 118*c* after the cleaning by the cleaning brush 137 from the lower surface portion 118*c*. An inner frame 119 is disposed inside a portion of the glue belt 117 with which a distal end portion of the rubber blade 139 is brought into contact. The inner frame 119 is disposed in the housing 112 in an extending manner in the X direction, and supports the glue belt 117 from the inside. With such a configuration, the glue belt 117 can resist against a pressing force from the rubber blade 139.

Figure 4:
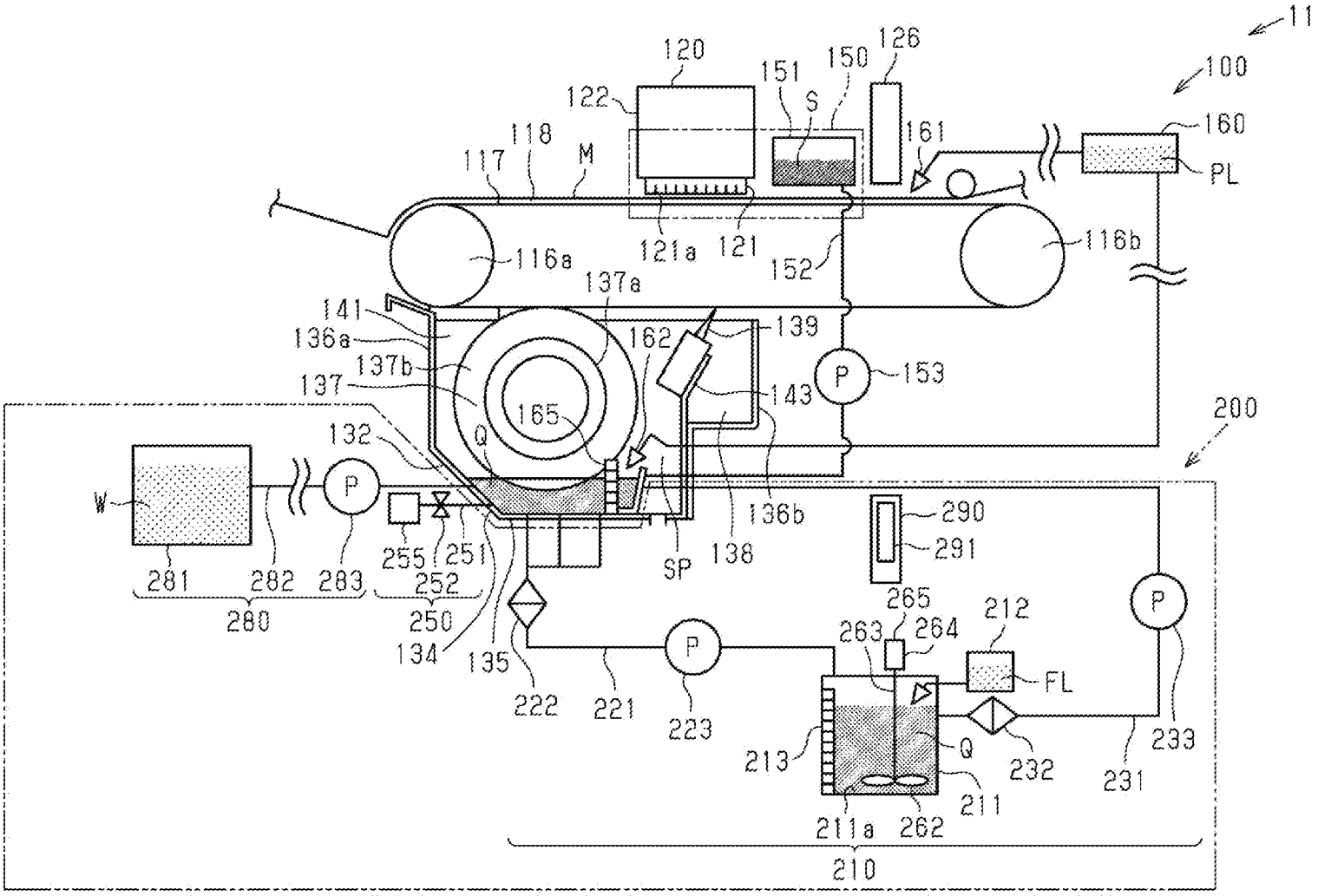
FIG. 4 is a schematic view illustrating a printing apparatus and a treatment apparatus in the printing system illustrated in FIG. 1.

As illustrated in FIG. 4, the printing apparatus 100 includes a maintenance unit 150 configured to perform maintenance of the liquid jetting head 121. The liquid jetting head 121 includes a plurality of nozzles 121*a* that open at a surface of the liquid jetting head 121 that faces the recording surface of the medium M. The maintenance unit 150 is controlled by the printing apparatus control unit 126.

In the printing apparatus 100, maintenance operations such as capping, flushing, cleaning, and the like are performed in order to prevent or eliminate a failure in jetting caused by clogging of the nozzle 121*a* of the liquid jetting head 121 or sticking of a foreign material to the nozzle 121*a*.

Here, "capping" refers to an operation in which a cap, not illustrated in the drawing, comes into contact with the liquid jetting head 121 so as to surround the opening of the nozzle 121*a* when the liquid jetting head 121 does not perform jetting of the liquid. With such a configuration, a closed space region is formed between the cap and a lower surface side of the liquid jetting head 121 at which the nozzles 121*a* open in a surrounded manner. Due to the capping, the increase of viscosity of a liquid in the nozzle 121*a* is suppressed and hence, the occurrence of a failure in jetting can be prevented.

Here, "flushing" refers to a jetting operation for discharging droplets not relating to recording from the nozzles 121*a* as a waste liquid S. Due to the flushing, a liquid whose viscosity is increased, bubbles or a foreign material that causes a failure in jetting is discharged from the nozzles 121*a*. Accordingly, clogging of the nozzles 121*a* can be prevented. The flushing is performed by jetting droplets from the nozzles 121*a* toward the inside of the cap, not illustrated in the drawing, as the waste liquid S.

The cleaning refers to an operation in which a suction force is added to the nozzles 121*a* of the liquid jetting head 121 so that a liquid is forcibly discharged from the nozzles 121*a* as the waste liquid S. The cap, not illustrated in the drawing, is brought into contact with the liquid jetting head 121 so as to surround the openings of the nozzles 121*a* and hence, the closed space region is formed between the cap and a lower surface side of the liquid jetting head 121 at which the nozzles 121*a* open in a surrounded manner. Further, by driving a suction unit, not illustrated in the drawing, in such a state, a negative pressure is generated in the closed space region and hence, suction cleaning is performed where the liquid in the liquid jetting head 121 is discharged as the waste liquid S through the nozzles 121*a*.

The maintenance unit 150 includes a waste liquid collection unit 151 that is configured to collect a liquid discharged from the liquid jetting head 121 into the cap, not illustrated in the drawing, as the waste liquid S in the maintenance operation. Further, the maintenance unit 150 also includes a waste liquid delivery flow path 152 and a waste liquid delivery pump 153. One end of the waste liquid delivery flow path 152 communicates with the waste liquid collection unit 151, and the other end of the liquid delivery flow path 152 communicates with the storage tank 134. With such a configuration, the waste liquid delivery flow path 152 makes the waste liquid collection unit 151 and the storage tank 134 communicate with each other. The waste liquid delivery pump 153 delivers the waste liquid S from the waste liquid collection unit 151 toward the storage tank 134 in the waste liquid delivery flow path 152.

As illustrated in FIG. 4, the printing apparatus 100 includes a pre-treatment agent adding unit 160. The pre-treatment agent adding unit 160 includes a first adding unit 161. The pre-treatment agent adding unit 160 is configured to add a pre-treatment agent PL, by the first adding unit 161, to a medium M to which a liquid is not yet jetted by the liquid jetting unit 120. The pre-treatment agent PL contains a component capable of causing a coagulation reaction with at least a portion of the components contained in the liquid. In the present embodiment, the pre-treatment agent PL contains a component capable of causing a coagulation reaction with at least a portion of an ink component that the ink being an example of the liquid contains by coagulation reaction. By adding the pre-treatment agent PL that contains a component capable of causing a coagulation reaction with at least a portion of the components contained in the liquid to the medium M to which the liquid is not yet jetted, coagulation of the liquid on the medium M after the liquid has been jetted onto the medium M is facilitated and hence, bleeding of the liquid on the medium M can be prevented. Further, by adding the pre-treatment agent PL, a fixing property and a chromogenic property of ink are improved. The ink component may contain at least either one of a dye or a pigment. The ink is classified into a dye based ink containing a dye as a part of the component and a pigment based ink which contains a pigment as part of the component. In the dye based ink, the ink component capable of causing a coagulation reaction with the pre-treatment agent PL may contain a dye. In the pigment based ink, the ink component capable of causing a coagulation reaction with the pre-treatment agent PL may contain a pigment.

The pre-treatment agent adding unit 160 includes a second adding unit 162. The pre-treatment agent adding unit 160 is configured to add the pre-treatment agent PL, by the second adding unit 162, to the cleaning liquid Q in the storage tank 134. By adding the pre-treatment agent PL to the cleaning liquid Q in the storage tank 134, at least a portion of the ink component contained in the ink that is removed by the above-mentioned cleaning brush 137 is coagulated in the storage tank 134. That is, particles of the ink component dispersed in the cleaning liquid Q in the storage tank 134 are coagulated to each other and hence, the settling of the particles is facilitated. The ink is an example of the liquid, and at least a portion of the ink component is an example of the coagulated material. Here, "coagulated material" refers to a substance that is produced by coagulation caused by coagulation reaction with a pre-treatment agent PL, a coagulating agent FL or the like described later, or a substance that is coagulated by coagulation reaction with the pre-treatment agent PL, the coagulating agent FL, or the like.

The pre-treatment agent adding unit 160 may be configured to add the pre-treatment agent PL to the cleaning liquid Q in a coagulation tank 211 described later instead of adding the pre-treatment agent PL to the cleaning liquid Q in the storage tank 134. Further, the pre-treatment agent adding unit 160 may be configured to add the pre-treatment agent PL to the cleaning liquid Q in the storage tank 134 and to add the pre-treatment agent PL also to the cleaning liquid Q in the coagulation tank 211 described later. In other words, the pre-treatment agent adding unit 160 is configured to add the pre-treatment agent PL to at least one of the cleaning liquid Q in the storage tank 134 and the cleaning liquid Q in the coagulation tank 211.

The printing apparatus 100 may include a liquid level sensor 165 for detecting a position of a liquid level of the cleaning liquid Q in the storage tank 134 in the reservoir 134. For example, when the liquid level sensor 165 detects that a height of the liquid level in the reservoir 134 is lowered to a predetermined position due to evaporation of moisture contained in the cleaning liquid Q, a message that facilitates the replenishment of the cleaning liquid Q in the storage tank 134 may be displayed on the display unit 131 illustrated in FIG. 1.

As illustrated in FIG. 4, the treatment apparatus 200 includes a treatment apparatus control unit 290 and a circulation unit 210. The treatment apparatus 200 may further include a concentration measuring unit 250 and a water supply unit 280. The treatment apparatus 200 is configured to treat the cleaning liquid Q used in a cleaning operation of the glue belt 117 configured to support and transport the medium M in the printing apparatus 100 for the purpose of reusing the cleaning liquid Q in the printing apparatus 100.

The treatment apparatus control unit 290 includes a CPU not illustrated in the drawing, and a memory. The CPU is an arithmetic processing unit. The memory is a storage device configured to secure a region in which programs run by the CPU are stored, a working region for running the programs, and the like. The memory includes a storage element such as a RAM, EEPROM or the like, a storage, or the like. The CPU is configured to control operations of the respective units of the treatment apparatus 200 in accordance with the programs stored in the memory. The treatment apparatus control unit 290 is configured to perform wired or wireless communication with the printing apparatus control unit 126 of the printing apparatus 100, and to share information with the printing apparatus control unit 126.

Information that the treatment apparatus control unit 290 shares with the printing apparatus control unit 126 includes a printing state of the medium M and a state of the printing apparatus 100. The printing state of the medium M is, for example, a type of the medium M that is being subjected to printing, a thickness of the medium M that is being subjected to printing, a duty of print data on the medium M which is being subjected to printing, a jetting amount of ink, and the like. Here, "duty of print data" is a concentration in the print data. Here, "the state of the printing apparatus 100" is information indicating a state of the printing apparatus 100 such as "printing being underway", "printing being stopped", "ink exchange being underway" or the like. The state of the printing apparatus 100 also includes information indicating the states of respective units of the printing apparatus 100, such as an output value of the liquid level sensor 165 for detecting the position of the liquid level of the cleaning liquid Q in the storage tank 134.

The concentration measuring unit 250 is mounted on an inner side surface of the storage tank 134, and is configured to measure the concentration of the ink component contained in the cleaning liquid Q by sampling the cleaning liquid Q in the storage tank 134. The concentration measuring unit 250 is coupled to the storage tank 134 of the printing apparatus 100. The concentration measuring unit 250 includes a sampling tube 251 having a flow path for the cleaning liquid Q, a concentration measuring valve 252 configured to open and close the flow path for the cleaning liquid Q in the sampling tube 251, and a concentration measuring unit 255 configured to measure the concentration of the ink component contained in a sample of the cleaning liquid Q collected from the sampling tube 251. To enable sampling of the cleaning liquid Q in the storage tank 134 at the side surface of the storage tank 134, the sampling tube 251 makes the storage tank 134 and the concentration measuring unit 255 communicate with each other in a state where one end of the sampling tube 251 is coupled to the storage tank 134, and the other end of the sampling tube 251 is coupled to the concentration measuring unit 255. For example, as the concentration measuring unit 255, a spectral densitometer or the like that obtains the concentration of the ink component based on a spectral reflectance or a spectral transmittance of a sample of the cleaning liquid Q.

The water supply unit 280 includes a water tank 281 and a water supply flow path 282. The water supply unit 280 is coupled to the storage tank 134 of the printing apparatus 100. The water tank 281 is configured to store water W to be supplied to the storage tank 134 of the printing apparatus 100. The water supply flow path 282 makes the storage tank 134 and the water tank 281 communicate with each other in a state where one end of the water supply flow path 282 is coupled to the storage tank 134, and the other end of the water supply flow path 282 is coupled to the water tank 281. The water supply flow path 282 includes a third pump 283 that is disposed in the water supply flow path 282 and is configured to transfer water W stored in the water tank 281 to the storage tank 134 through the water supply flow path 282.

In the case of exchanging the ink used in the printing apparatus 100 or the like, there may be a case where a large amount of waste liquid S that stays in the flow path of the printing apparatus 100 flows into the storage tank 134. In such a case, it is desirable that the third pump 283 be driven so that water W is delivered to the storage tank 134 so as to dilute the cleaning liquid Q into which a large amount of waste liquid S flows by water W. A user can allow the water supply unit 280 to supply a predetermined amount of water W into the storage tank 134 by operating the operation unit 130. With such a configuration, it is possible to suppress the occurrence of a state where the concentration of the ink component contained in the cleaning liquid Q is increased so that the ink is fixed to the respective units of the apparatus.

An opening/closing valve may be provided in place of the third pump 283. In this case, water W may be supplied from the water tank 281 to the storage tank 134 by opening the open/close valve by the user. Further, there may be adopted a configuration where the treatment apparatus 200 and the printing system 11 do not include the water supply unit 280, and a user directly adds water W to the cleaning liquid Q in the storage tank 134.

The treatment apparatus control unit 290 described above may also be configured to automatically supply water W in the water supply unit 280 to the storage tank 134. For example, there may be adopted a configuration where the third pump 283 is driven corresponding to a result of the concentration measurement performed by the concentration measuring unit 250 so that the cleaning liquid Q is automatically diluted by water W. Further, there may also be adopted a configuration where the treatment apparatus control unit 290 supplies water W in the storage tank 134 based on information from the printing apparatus control unit 126 when the liquid level sensor 165 detects that a liquid level in the storage tank 134 is lowered to a predetermined position due to evaporation of moisture contained in the cleaning liquid Q.

As illustrated in FIG. 4, the circulation unit 210 includes a coagulation tank 211, a coagulating agent adding unit 212, a collection flow path 221, and a supply flow path 231. Further, the circulation unit 210 may include, in the coagulation tank 211, a liquid level sensor 213 configured to detect a position of a liquid level of the cleaning liquid Q, and a stirring unit 265 configured to stair the cleaning liquid Q. The circulation unit 210 is coupled to the reservoir 134 of the printing apparatus 100. With such a configuration, the circulation unit 210 forms a flow path through which the cleaning liquid Q circulates by the storage tank 134 of the printing apparatus 100, the collection flow path 221, the coagulation tank 211, and the supply flow path 231. That is, the storage tank 134 and the collection flow path 221 communicate with each other, the collection flow path 221 and the coagulation tank 211 communicate with each other, the coagulation tank 211 and the supply flow path 231 communicate with each other, and the supply flow path 231 and the storage tank 134 communicate with each other.

The coagulation tank 211 is configured to store the cleaning liquid Q collected from the storage tank 134 through the collection flow path 221 in the inside thereof having a box shape. A coagulating agent FL is added to the cleaning liquid Q stored in the coagulation tank 211. An upper part of the coagulation tank 211 having a box shape may be opened, or the upper part of coagulation tank 211 having a box shape may be sealed. In the present embodiment, the waste liquid S collected from the waste liquid collection unit 151 of the printing apparatus 100 flows into the cleaning liquid Q in the storage tank 134 and is stored in the storage tank 134, and then flows into the coagulation tank 211. However, the waste liquid S may not be made to flow into the cleaning liquid Q in the storage tank 134, and may be stored in a state where the waste liquid S flows into the cleaning liquid Q in the coagulation tank 211. In other words, the waste liquid S may be made to directly flow into the coagulation tank 211 and may be stored in the coagulation tank 211.

The coagulating agent adding unit 212 is disposed at an upper side in the coagulation tank 211, and is configured to add the coagulating agent FL to the cleaning liquid Q in the coagulation tank 211. With such a configuration, the coagulation tank 211 is configured to store the cleaning liquid Q collected from the storage tank 134 after being used in the cleaning operation and to which the pre-treatment agent PL and the coagulating agent FL are added. The coagulating agent FL is a medicament used to coagulate particles dispersed in a liquid thus facilitating settling of the particles. In the present embodiment, the coagulating agent FL is used for facilitating the settling of the ink component and lint and foreign materials produced attributed to the base material of the medium by coagulating these materials. The treatment apparatus 200 and the printing system 11 may not include the coagulating agent adding unit 212, and a user may add the coagulating agent FL to the cleaning liquid Q in the coagulation tank 211. Further, a user may add the coagulating agent FL to the cleaning liquid Q in the storage tank 134, or the user may add the coagulating agent FL to the cleaning liquid Q in the collection flow path 221 collected from the storage tank 134 to the coagulation tank 211. There may be a case where ink component is sufficiently coagulated using only the pre-treatment agent PL depending on a type of ink to be used. In such a case, it is unnecessary to add the coagulating agent FL to the cleaning liquid Q and hence, the treatment apparatus 200 and the printing system 11 may not include the coagulating agent adding unit 212.

On the other hand, in a case where the ink component is sufficiently coagulated by adding only the coagulating agent FL, it is unnecessary to add the pre-treatment agent PL to the cleaning liquid Q and hence, the treatment apparatus 200 and the printing system 11 may not include the second adding unit 162.

The coagulating agent adding unit 212 may be configured to add the coagulating agent FL according to the concentration measured by the concentration measuring unit 250 described above. For example, an amount of coagulating agent FL added by the coagulating agent adding unit 212 may be adjusted by calculating an amount of coagulating agent FL required for generating coagulation of the ink component by the treatment apparatus control unit 290 corresponding to the concentration measured by the concentration measuring unit 250. Further, there may be adopted a configuration where the treatment apparatus control unit 290 determines whether or not the concentration measured by the concentration measuring unit 250 has reached a predetermined value, and using the determination that the concentration measured by the concentration measuring unit 250 has reached the predetermined value as a trigger, the cleaning liquid Q is transferred from the storage tank 134 to the coagulation tank 211, and the coagulating agent adding unit 212 adds a predetermined amount of coagulating agent FL to the cleaning liquid Q so that the ink component is coagulated. Further, there may be adopted a configuration where, when the concentration measured by the concentration measuring unit 250 exceeds the predetermined value, the cleaning liquid Q in the storage tank 134 is diluted with water W by the above-mentioned water supply unit 280 until the concentration of the cleaning liquid Q reaches a predetermined value and, thereafter, the cleaning liquid Q is transferred from the storage tank 134 to the coagulation tank 211.

The treatment apparatus control unit 290 may include a concentration estimation unit 291 configured to estimate the concentration of the ink component contained in the cleaning liquid Q based on a printing state of the medium M, and the coagulating agent adding unit 212 may be configured to add the coagulating agent FL according to the concentration of the ink component estimated by the concentration estimation unit 291. For example, an amount of coagulating agent FL to be added may be adjusted in such a manner that the concentration of the ink component contained in the cleaning liquid Q is estimated based on a type of medium M during printing, a thickness of the medium M during printing, the duty of the print data during printing, a discharge amount of ink, and the like. For example, in a case that the medium M is of a type where stitching of the medium M is coarse so that ink is liable to stick to the transporting belt, it is estimated that the concentration of the ink component contained in the cleaning liquid Q is increased. For example, when a thickness of the medium M is thin so that ink is liable to stick to the transporting belt, it is estimated that the concentration of the ink component contained in the cleaning liquid Q is increased. For example, when a duty of print data is large, it is estimated that the concentration of the ink component is increased. For example, when the discharge amount of ink is large, it is estimated that the concentration of the ink component is increased. Accordingly, an amount of coagulating agent FL to be added by the coagulating agent adding unit 212 may be adjusted by calculating an amount of coagulating agent FL required for generating the coagulation of the ink component by the treatment apparatus control unit 290 corresponding to the concentration of the ink component estimated by the concentration estimation unit 291. Further, there may be adopted a configuration where the treatment apparatus control unit 290 determines whether or not the concentration of the ink component estimated by the concentration estimation unit 291 has reached a predetermined value, and using the determination that the concentration of the ink component estimated by the concentration estimation unit 291 has reached the predetermined value as a trigger, the cleaning liquid Q is transferred from the storage tank 134 to the coagulation tank 211, and the coagulating agent adding unit 212 adds a predetermined amount of coagulating agent FL so that the ink component is coagulated. In a case where the treatment apparatus 200 includes the concentration estimation unit 291, the concentration measuring unit 250 may be eliminated.

The coagulation operation performed by the treatment apparatus 200 is performed in the coagulation tank 21 disposed at a location remote from the glue belt 117. With such a configuration, the treatment apparatus 200 is not affected by a state of the glue belt 117. That is, the treatment apparatus 200 is configured to perform a coagulation operation where the coagulating agent FL is added to the cleaning liquid Q in the coagulation tank 211 so that the ink component is coagulated, in parallel with the cleaning operation of the glue belt 117 performed by the printing apparatus 100. With such a configuration, the printing system 11 performs the coagulation operation where the coagulating agent FL is added to the cleaning liquid Q in the coagulation tank 211 so that the ink component is coagulated, and the cleaning operation, in parallel. In the same manner, the treatment apparatus 200 is configured to perform the coagulation operation where the coagulating agent FL is added to the cleaning liquid Q in the coagulation tank 211 so that the ink component is coagulated, in parallel with the printing operation performed by jetting the liquid to the medium M supported by the glue belt 117 by the printing apparatus. With such a configuration, the printing system 11 performs the coagulation operation where the coagulating agent FL is added to the cleaning liquid Q in the coagulation tank 211 so that the ink component is coagulated, and the printing operation, in parallel.

In the present embodiment, the treatment apparatus control unit 290 of the treatment apparatus 200 includes the concentration estimation unit 291. However, the printing apparatus control unit 126 of the printing apparatus 100 may include a concentration estimation unit. Further, there may be adopted a configuration where the treatment apparatus control unit 290 and the printing apparatus control unit 126 share information of the concentration of the ink component contained in the cleaning liquid Q estimated by the concentration estimation unit of the printing apparatus control unit 126, and the treatment apparatus control unit 290 allows the coagulating agent adding unit 212 to add the coagulating agent FL to the cleaning liquid Q based on the information.

The liquid level sensor 213 is disposed in the coagulation tank 211, and is configured to detect a position of a liquid level of the cleaning liquid Q in the coagulation tank 211. For example, the treatment apparatus control unit 290 may be configured to feed a predetermined amount of cleaning liquid Q in the storage tank 134 toward the coagulation tank 211 or to feed a predetermined amount of cleaning liquid Q in the coagulation tank 211 toward the storage tank 134 when the liquid level sensor 213 detects that the height of the liquid level of the cleaning liquid Q in the coagulation tank 211 deviates from a predetermined range.

The stirring unit 265 is configured to stir the cleaning liquid Q to which the pre-treatment agent PL and the coagulating agent FL are added in the coagulation tank 211. The stirring unit 265 includes a rotary shaft 263, a stirring motor 264 coupled to one end side of the rotary shaft 263, and stirring members 262 each having a substantially blade shape and coupled to the other end side of the rotary shaft 263. The shape of the stirring member 262 may be a blade shape or a plate shape. Further, the number of the stirring members 262 coupled to the rotary shaft 263 is also not limited. That is, it is sufficient that the stirring members 262 are capable of stirring the liquid. The stirring motor 264 is configured to rotate the rotary shaft 263, and the stirring members 262 are configured to stir the cleaning liquid Q in a state where the stirring members 262 are mounted on the rotary shaft 263 at a position in the vicinity of the bottom portion of the coagulation tank 211 such that the stirring members 262 do not come into contact with the bottom portion of the coagulation tank 211. The stirring unit 265 may be configured to stir the liquid by a reciprocating motion or a rocking motion in place of a rotary motion.

The collection flow path 221 communicates with the storage tank 134 in such a manner that one end of the collection flow path 221 is coupled to a plurality of portions of the bottom wall 135 of the storage tank 134 on an outer side surface of the bottom wall 135. The collection flow path 221 has the other end thereof communicated with the coagulation tank 211. With such a configuration, the collection flow path 221 couples the reservoir 134 and the coagulation tank 211 to each other in a communicable manner.

The collection flow path 221 is configured to collect the cleaning liquid Q used in the cleaning operation of the glue belt 117 from the printing apparatus 100 to the treatment apparatus 200 for reuse. The collection flow path 221 includes a first pump 223 that is disposed in the collection flow path 221 and is configured to transfer the cleaning liquid Q stored in the storage tank 134 to the coagulation tank 211. The collection flow path 221 has a first filter 222 between the storage tank 134 and the first pump 223.

When the cleaning liquid Q passes through the first filter 222, a coagulated material of at least a portion of the ink component that is an example of a coagulated material produced by coagulation caused by adding the pre-treatment agent PL to the cleaning liquid Q by the pre-treatment agent adding unit 160 in the storage tank 134 is captured by the first filter 222. That is, the first filter 222 captures the coagulated ink component that is produced by adding the pre-treatment agent PL to the cleaning liquid Q by the pre-treatment agent adding unit 160 in the storage tank 134 thus separating the coagulated ink component from the cleaning liquid Q. Lint, foreign materials and the like produced attributed to the base material of the medium contained in the cleaning liquid Q are captured by the first filer 222 together with the ink component.

The supply flow path 231 is communicated with the coagulation tank 211 in a state where one end of the supply flow path 231 is coupled to the coagulation tank 211 at a position below a liquid level of the cleaning liquid Q located when the cleaning liquid Q is stored in the coagulation tank 211 and above the coagulation tank 211. The upper side of the coagulation tank 211 is a position above the center between the liquid level of the cleaning liquid Q when the cleaning liquid Q is stored and the bottom surface 211*a* of the coagulation tank 211. The supply flow path 231 is communicated with the storage tank 134 at the other end thereof. With such a configuration, the supply flow path 231 couples the coagulation tank 211 and the storage tank 134 to each other in a communicable manner.

The supply flow pat 231 is configured to supply the cleaning liquid Q from which the coagulated material of at least a portion of the ink component that is an example of the coagulated material is separated by the second filter 232 from the treatment apparatus 200 to the printing apparatus 100 for reuse. The supply flow path 231 includes a second pump 233 that is disposed in the supply flow path 231, and is an example of a pump for transferring the cleaning liquid Q stored in the coagulation tank 211 to the storage tank 134 in the supply flow path 231. The supply flow path 231 has a second filter 232 that is an example of a separation unit between the coagulation tank 211 and the second pump 233.

When the cleaning liquid Q passes through the second filter 232, a coagulated material of at least a portion of the ink component that is an example of a coagulated material produced by coagulation caused by adding the pre-treatment agent PL to the cleaning liquid Q by the pre-treatment agent adding unit 160 in the storage tank 134 is captured by the second filter 232. Then, when the cleaning liquid Q passes through the second filter 232, a coagulated material of at least a portion of the ink component that is an example of a coagulated material produced by coagulation caused by adding the coagulating agent FL to the cleaning liquid Q by the coagulating agent adding unit 212 in the coagulation tank 211 is captured by the second filter 232. That is, the second filter 232 captures the coagulated ink component that is produced by adding the pre-treatment agent PL to the cleaning liquid Q by the pre-treatment agent adding unit 160 in the storage tank 134 and the coagulated ink component that is produced by adding the coagulating agent FL to the cleaning liquid Q by the coagulating agent adding unit 212 in the coagulation tank 211 thus separating these coagulated ink components from the cleaning liquid Q. Lint, foreign materials and the like produced attributed to the base material of the medium that cannot be captured by the first filter 222 are captured by the second filer 232 together with the coagulated ink component, and are separated from the cleaning liquid Q.

In the present embodiment, most of the coagulated ink component that is produced by adding the pre-treatment agent PL to the cleaning liquid Q by the pre-treatment agent adding unit 160 in the storage tank 134, and the lint and foreign materials produced attributed to the base material of the medium are captured by the first filter 222 described above. Accordingly, by the second filter 232, the coagulated ink component that is produced by adding the coagulating agent FL to the cleaning liquid Q by the coagulating agent adding unit 212 in the coagulation tank 211 is mainly captured.

The second pump 233 is configured to be rotatable in a normal direction and a reverse direction. That is, the second pump 233 that is an example of the pump is configured to transfer the cleaning liquid Q from the coagulation tank 211 to the storage tank 134 and is also configured to transfer the cleaning liquid Q from the storage tank 134 to the coagulation tank 211 in the supply flow path 231. When the cleaning liquid Q is transferred from the storage tank 134 to the coagulation tank 211, a coagulated material of at least a portion of the ink component that is an example of the coagulated material produced by coagulation and captured by the second filter 232 is separated from the second filter 232 toward a coagulation tank 211 side. Then, the coagulated ink component, lint and foreign materials produced attributed to the base material of the medium, and the like that are captured by the second filter 232 are separated from the second filter 232 and settle on the bottom in the coagulation tank 211, for example. That is, the supply flow path 231 is configured to remove the coagulated material of at least a portion of the ink component that is an example of the coagulated material from the second filter 232 by transferring the cleaning liquid Q from the storage tank 134 to the coagulation tank 211. With such a configuration, clogging of the second filter 232 is eliminated, and the cleaning liquid Q from which the ink component is separated can be supplied to the storage tank 134 for reuse.

The coagulating agent adding unit 212 may be disposed on an upper side in the storage tank 134 and may be configured to add the coagulating agent FL to the cleaning liquid Q in the storage tank 134. In this case, the storage tank 134 that is an example of the cleaning liquid storage unit may also have a function of the coagulation tank. In other words, the coagulating agent adding unit 212 may be disposed on an upper side in the storage tank 134 that is an example of the cleaning liquid storage unit and also is an example of the coagulation tank, and may be configured to add the coagulating agent FL to the cleaning liquid Q in the storage tank 134. In this case, the collection flow path 221 may also have a function of the supply flow path 231. In other words, there may be adopted a configuration where, in a state where one end of the collection flow path 221 is coupled to the outer side surface of the bottom wall 135 of the storage tank 134 so as to communicate with the inside of the storage tank 134, the other end of the collection flow path 221 is coupled to an outer side surface of a side wall portion 141 of the storage tank 134 so as to communicate with the inside of the storage tank 134. That is, the flow path through which the cleaning liquid Q circulates may be formed of only the storage tank 134 that is an example of the cleaning liquid storage unit and also is an example of the coagulation tank and the collection flow path 221. There may be adopted a configuration where the cleaning liquid Q from which a coagulated material of at least a portion of the ink component that is an example of the coagulated material is separated by the first filter 222 that is an example of the separation unit disposed on the collection flow path 221 may be supplied to the storage tank 134 for reuse by the first pump 223 that is an example of a pump disposed on the collection flow path 221.

Method of Reusing Cleaning Liquid

Figure 5:
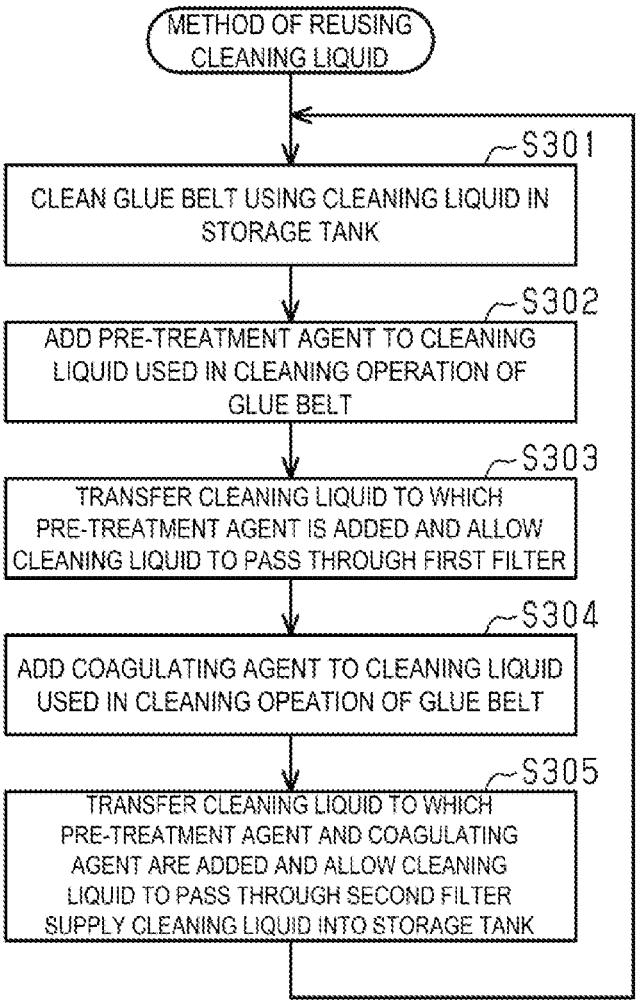
FIG. 5 is a flow chart illustrating a method of reusing a cleaning liquid in the printing system illustrated in FIG. 1.

With reference to a flowchart illustrated in FIG. 5, with respect to the flow of the operation of the printing system 11 in the method of reusing the cleaning liquid Q and the flow of the method of reusing the cleaning liquid Q in the printing system 11, operations in respective steps are described sequentially.

In step S301, the printing system 11 cleans the glue belt 117 using the cleaning liquid Q in the storage tank 134. That is, the cleaning brush 137 performs the cleaning operation of the glue belt 117 using the cleaning liquid Q stored in the storage tank 134. The ink component and lint and foreign materials produced attributed to the base material of the medium that are removed from the glue belt 117 by the cleaning brush 137 are collected by being mixed into the cleaning liquid Q in the storage tank 134. Step S301 is a step where the cleaning operation of the glue belt 117 that is an example of the transporting belt is performed using the cleaning liquid Q.

In step S302, the printing system 11 adds the pre-treatment agent PL to the cleaning liquid Q used in the cleaning operation of the glue belt 117. That is, the pre-treatment agent adding unit 160 adds the pre-treatment agent PL to the cleaning liquid Q in the storage tank 134. The pre-treatment agent PL coagulates the ink component mixed into the cleaning liquid Q in the storage tank 134, and facilitates settling of the ink component as a coagulated material. Step S302 is a step where the pre-treatment agent PL is added to the cleaning liquid Q used in the cleaning operation so that the coagulation is performed.

In step S303, the printing system 11 transfers the cleaning liquid Q to which the pre-treatment agent PL is added, and the cleaning liquid Q is made to pass through the first filter 222. That is, when the first pump 223 transfers the cleaning liquid Q stored in the storage tank 134 to the coagulation tank 211, the cleaning liquid Q is made to pass through first filter 222. The first filter 222 separates a coagulated material of at least a portion of an ink component that is an example of the coagulated material produced by coagulation caused by the pre-treatment agent PL and a coagulated material formed of lint and foreign materials produced attributed to the base material of the medium from the cleaning liquid Q by capturing these coagulated materials. Step S303 is a step where the coagulated materials that are produced by coagulation caused by adding the pre-treatment agent PL to the cleaning liquid Q are separated from the cleaning liquid Q to which the pre-treatment agent PL is added.

In step S304, the printing system 11 adds the coagulating agent FL to the cleaning liquid Q used in the cleaning operation of the glue belt 117. That is, the coagulating agent adding unit 212 adds the coagulating agent FL to the cleaning liquid Q in the coagulation tank 211. The coagulating agent adding unit 212 may add the coagulating agent FL according to the concentration measured by the concentration measuring unit 250, or may add the coagulating agent FL according to the concentration estimated by the concentration estimation unit 291. The coagulating agent FL coagulates the ink component and lint and foreign materials produced attributed to a base material of the medium that are mixed in the cleaning liquid Q in the coagulation tank 211, and facilitates settling of these materials as a coagulated material. Step S304 is a step where the coagulating agent FL is added to the cleaning liquid Q used in the cleaning operation so that the coagulation is performed.

In step S305, the printing system 11 transfers the cleaning liquid Q to which the pre-treatment agent PL and the coagulating agent FL are added, and the cleaning liquid Q is made to pass through the second filter 232. Then, the printing system 11 supplies the cleaning liquid Q into the storage tank 134. That is, when the second pump 223 transfers the cleaning liquid Q stored in the coagulation tank 211 to the storage tank 134, the cleaning liquid Q is made to pass through second filter 232. The second filter 222 separates a coagulated material of at least a portion of an ink component that is an example of the coagulated material produced by coagulation caused by the pre-treatment agent PL and the coagulating agent FL from the cleaning liquid Q by capturing the coagulated material. Step S305 is a step where the coagulated material produced by coagulation caused by adding the pre-treatment agent PL to the cleaning liquid Q is separated from the cleaning liquid Q to which the pre-treatment agent PL is added and. At the same time, the step S305 is also a step where the coagulated material produced by coagulation caused by adding the coagulating agent FL to the cleaning liquid Q is separated from the cleaning liquid Q to which the coagulating agent FL is added.

In step S305, the cleaning liquid Q supplied into the storage tank 134 is used again for cleaning the glue belt 117 in step S301. That is, in the printing system 11, the cleaning liquid Q is reused.

In the present embodiment, the printing system 11 includes two filters, that is, the first filter 222 and the second filter 232. With such a configuration, the ink component, and the coagulated material that is produced by coagulation of lint and foreign materials produced attributed to the base material of the medium are captured by two filters and are separated from the cleaning liquid Q to which the pre-treatment agent PL is added. Accordingly, in the present embodiment, both the step S303 and the step S305 are steps where the coagulated material that is produced by coagulation caused by adding the pre-treatment agent PL to the cleaning liquid Q is separated from the cleaning liquid Q to which the pre-treatment agent PL is added.

The manner of operations of the present embodiment are described.

This embodiment provides the printing apparatus 100 including the glue belt 117 configured to support and transfer the medium M, the liquid jetting unit 120 configured to jet a liquid onto the medium M so as to perform a printing operation, the storage tank 134 configured to store the cleaning liquid Q, and the cleaning brush 137 configured to perform the cleaning operation of the glue belt 117 using the cleaning liquid Q. Further, the treatment apparatus 200 is disposed below the glue belt 117. The treatment apparatus 200 is coupled to the printing apparatus 100 by coupling the circulation unit 210, the concentration measuring unit 250, and the water supply unit 280 to the storage tank 134.

The collection flow path 221 that the circulation unit 210 includes communicates with the storage tank 134 in such a manner that one end of the collection flow path 221 is coupled to the outer side surface of the bottom wall 135 of the storage tank 134. With such a configuration, the cleaning liquid Q in the storage tank 134 can be collected by the first pump 223 to the coagulation tank 211 that the circulation unit 210 includes. The supply flow path 231 that the circulation unit 210 includes communicates with the coagulation tank 211 in a state where one end of the supply flow path 231 is coupled to an upper side of the coagulation tank 211. With such a configuration, the cleaning liquid Q in the coagulation tank 211 can be supplied to the storage tank 134 by the second pump 233. The cleaning liquid Q can be circulated between the storage tank 134 and the coagulation tank 211 by coupling the collection flow path 221 that the circulation unit 210 includes and the supply flow path 231 that the circulation unit 210 includes to the storage tank 134.

The concentration measuring unit 250 communicates with the storage tank 134 in a state where one end of the sampling tube 251 that the concentration measuring unit 250 includes is coupled to the storage tank 134. With such a configuration, by opening and closing the concentration measuring valve 252, the cleaning liquid Q in the storage tank 134 can be sampled and, then, the concentration of the ink component contained in the cleaning liquid Q can be measured.

The water supply unit 280 communicates with the storage tank 134 in a state where one end of the water supply flow path 282 that the water supply unit 280 includes is coupled to the storage tank 134. With such a configuration, water W can be supplied to the storage tank 134 by the third pump 283 so as to dilute the cleaning liquid Q.

The treatment apparatus control unit 290 is connected to the printing apparatus control unit 126 via a wired or wireless connection. With such a configuration, the printing apparatus 100 and the treatment apparatus 200 can perform communication with each other, and share information with each other.

The treatment apparatus 200 is connected to the printing apparatus 100 and hence, the use of the printing system 11 is started. In printing, first, the pre-treatment agent adding unit 160 adds the pre-treatment agent PL, by the first adding unit 160, to the medium M to which the liquid is not yet jetted by the liquid jetting unit 120. Accordingly, a layer made of a pre-treatment agent can be formed on the medium M. Next, a printing operation is performed by jetting ink to the medium M by the liquid jetting unit 120 on the layer made of the pre-treatment agent. As a result, a printed image is formed on the medium M. The pre-treatment agent PL contains a component capable of causing a coagulation reaction with at least a portion of the ink component which the ink contains.

Accordingly, it is possible to prevent bleeding of the liquid on the medium M after printing. Further, by adding the pre-treatment agent PL, a fixing property and a chromogenic property of ink are improved.

By winding a portion of the medium M on which printing is already finished by the winding roller not illustrated in the drawing, the medium M is peeled off from the curved surface portion 118*b*. There may be a case where ink that penetrates the medium M from a front side to a back side of the medium M and lint produced attributed to the base material of the medium stick to the surface 118 from which the medium M is peeled off. The cleaning operation of the surface 118 of the glue belt 117 is performed by the cleaning brush 137 using the cleaning liquid Q stored in the storage tank 134. With such an operation, the ink and the lint produced attributed to the base material of the medium can be removed from the surface 118 of the glue belt 117, and the ink and the lint can be collected by being mixed into the cleaning liquid Q in the storage tank 134.

The pre-treatment agent adding unit 160 adds the pre-treatment agent PL, by the second adding unit 162, to the cleaning liquid Q in the storage tank 134. With such an operation, in the storage tank 134, at least a portion of the ink component contained in the ink that is removed by the cleaning brush 137 can be coagulated so that settling of the portion of the ink component can be facilitated.

The first pump 223 transfers the cleaning liquid Q to which the pre-treatment agent PL is added from the storage tank 134 to the coagulation tank 211. At this stage of the operation, the cleaning liquid Q to which the pre-treatment agent PL is added passes through the first filter 222. The coagulated ink component that is produced by adding the pre-treatment agent PL, and the lint and foreign materials produced attributed to the base material of the medium can be separated from the cleaning liquid Q by capturing these materials by the first filter 222.

The coagulating agent adding unit 212 adds the coagulating agent FL to the cleaning liquid Q in the coagulation tank 211. With such an operation, in the coagulation tank 211, an ink component, and lint and foreign materials produced attributed to the base material of the medium can be coagulated so that settling of the ink component, the lint and the foreign materials can be facilitated.

The coagulation operation where the coagulating agent FL is added to the cleaning liquid Q so that the ink component is coagulated is performed in the coagulation tank 211 that is disposed at a location remote from the glue belt 117. With such an operation, the coagulation operation can be performed without being affected by the state of the glue belt 117 that supports the medium M in the printing operation and is cleaned in the cleaning operation. That is, the coagulation operation can be performed in parallel with the cleaning operation of the glue belt 117 and the printing operation that is performed by jetting a liquid to the medium M supported on the glue belt 117.

The concentration measuring unit 250 measures the concentration of the ink component contained in the cleaning liquid Q by sampling the cleaning liquid Q in the storage tank 134. By measuring the concentration of the ink component contained in the cleaning liquid Q, an amount of coagulating agent FL required for coagulating the ink component is calculated based on the measured concentration, and only the required amount of coagulating agent FL can be added to the cleaning liquid Q.

The concentration estimation unit 291 estimates the concentration of the ink component contained in the cleaning liquid Q based on the printing state of the medium M. By estimating the concentration of the ink component contained in the cleaning liquid Q based on the printing state of the medium M, an amount of coagulating agent FL required for coagulating the ink component is calculated without using a dedicated concentration measurement sensor, and only the required amount of coagulating agent FL can be added to the cleaning liquid Q.

The stirring unit 265 stirs the cleaning liquid Q to which the pre-treatment agent PL and the coagulating agent FL are added in the coagulation tank 211. By stirring the cleaning liquid Q, the stirring unit 265 can make the concentration of the pre-treatment agent PL and the concentration of the coagulating agent FL in the cleaning liquid Q in the coagulation tank 211 approximately uniform respectively. Accordingly, the number of portions where the coagulation does not proceed because of the low concentration of the pre-treatment agent PL and the low concentration of the coagulating agent FL can be reduced. Further, by stirring the cleaning liquid Q, the stirring unit 265 can make the concentration of the ink component in the cleaning liquid Q in the coagulation tank 211 approximately uniform. Accordingly, the number of portions where coagulation does not proceed because of the high concentration of the ink component can be reduced.

The second pump 233 transfers the cleaning liquid Q to which the pre-treatment agent PL and the coagulating agent FL are added from the coagulation tank 211 to the storage tank 134. At this stage of the operation, the cleaning liquid Q to which the pre-treatment agent PL and the coagulating agent FL are added passes through the second filter 232. The coagulated ink component that is produced by adding the pre-treatment agent PL and the coagulating agent FL, and lint and foreign materials produced attributed to the base material of the medium that could not be captured by the first filter 222 can be separated from the cleaning liquid Q by capturing these materials by the second filter 232. Further, by transferring the cleaning liquid Q from which the ink component and the lint and the foreign materials produced attributed to the base material of the medium are separated to the storage tank 134, the cleaning liquid Q can be used again in the cleaning operation of the glue belt 117.

At a timing that a cumulative predetermined amount of cleaning liquid Q passes through the second filter 232 after starting the use of the printing system 11, the second pump 233 transfers the cleaning liquid Q from the storage tank 134 to the coagulation tank 211. At this stage of the operation, the cleaning liquid Q passes through the second filter 232 from a storage tank 134 side of the second filter 232 toward a coagulation tank 211 side of the second filter 232. With such an operation, the coagulated ink component and the coagulated lint and foreign materials produced attributed to the base material of the medium that are captured by the second filter 232 are pushed back toward the coagulation tank 211 side and are separated from the second filter 232. That is, the coagulated ink component and the coagulated lint and foreign materials produced attributed to the base material of the medium that are captured by the second filter 232 can be removed from the second filter 232.

When the cleaning liquid Q cannot pass through the second filter 232 due to the coagulated ink component and the coagulated lint and foreign materials produced attributed to the base material of the medium that are captured by the second filter 232, the operation of transferring the cleaning liquid Q stored in the coagulation tank 211 to the storage tank 134 is stopped. At this stage of the operation, by transferring the cleaning liquid Q from the storage tank 134 to the coagulation tank 211, the coagulated ink component and the coagulated lint and foreign materials produced attributed to the base material of the medium that are captured by the second filter 232 can be removed from the second filter 232. When the cleaning liquid Q is allowed to pass through the second filter 232, the operation of transferring the cleaning liquid Q stored in the coagulation tank 211 to the storage tank 134 is started again.

Advantageous effects of the present embodiment are described.

According to the printing system 11 that reuses the cleaning liquid Q for cleaning the glue belt 117 that is an example of the transporting belt of the present embodiment, the treatment apparatus 200 that reuses the cleaning liquid Q, and the method of reusing the cleaning liquid Q, it is possible to acquire the following advantageous effects.

(1) The printing system 11 includes the printing apparatus 100 and the treatment apparatus 200. The printing apparatus 100 includes the glue belt 117, the liquid jetting unit 120 configured to perform the printing operation by jetting ink onto the medium M, the storage tank 134 configured to store the cleaning liquid Q, and the cleaning brush 137 configured to perform the cleaning operation of the glue belt 117 using the cleaning liquid Q. The treatment apparatus 200 includes the coagulation tank 211 configured to store the cleaning liquid Q to which the coagulating agent FL is added, and the second filter 232. After the cleaning liquid Q is used in the cleaning operation of the glue belt 117, the coagulating agent FL is added to the cleaning liquid Q in the storage tank 134 and, then, the cleaning liquid Q is stored in the coagulation tank 211. The coagulated ink component that is produced by adding the coagulating agent FL to the cleaning liquid Q used in the cleaning operation is produced as a coagulated material. Then, when the cleaning liquid Q is supplied from the coagulation tank 211 to the storage tank 134 for reuse, the coagulated ink component in the cleaning liquid Q is separated from the cleaning liquid Q by the second filter 232. Then, the cleaning liquid Q is reused in the cleaning operation of the glue belt 117. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced.

(2) The printing system 11 includes the coagulating agent adding unit 212 configured to add the coagulating agent FL to the cleaning liquid Q in the coagulation tank 211. The coagulating agent FL is added to the cleaning liquid Q in the coagulation tank 211 by the coagulating agent adding unit 212 and hence, it is possible for the user to eliminate the cumbersomeness that the user has to add the coagulating agent FL to the cleaning liquid Q in the coagulation tank 211.

(3) The printing system 11 includes the concentration measuring unit 250 configured to measure the concentration of the ink component contained in the cleaning liquid Q, and the coagulating agent adding unit 212 is configured to add the coagulating agent FL according to the concentration measured by the concentration measuring unit 250. By measuring the concentration of the ink component contained in the cleaning liquid Q, an amount of coagulating agent FL required for coagulating the ink component is calculated based on the measured concentration, and the required amount of coagulating agent FL can be added to the cleaning liquid Q. Accordingly, the ink component contained in the cleaning liquid Q can be coagulated using an appropriate amount of coagulating agent FL.

(4) The printing system 11 includes the concentration estimation unit 291 configured to estimate the concentration of the ink component contained in the cleaning liquid Q based on a printing state of the medium M, and the coagulating agent adding unit 212 is configured to add the coagulating agent FL according to the concentration estimated by the concentration estimation unit 291. By estimating the concentration of the ink component contained in the cleaning liquid Q based on the printing state of the medium M, an amount of coagulating agent FL required for coagulating the ink component is calculated without using a dedicated concentration measurement sensor, and a required amount of coagulating agent FL can be added to the cleaning liquid Q. Accordingly, ink component contained in the cleaning liquid Q can be coagulated using an appropriate amount of coagulating agent FL while suppressing a cost of the printing system 11.

(5) The printing system 11 includes the pre-treatment agent adding unit 160 configured to add the pre-treatment agent PL to the medium M to which the liquid is not yet jetted by the liquid jetting unit 120. The pre-treatment agent PL contains a component capable of causing a coagulation reaction with at least a portion of the component contained in the ink jetted from the liquid jetting unit 120. That is, the pre-treatment agent PL contains a component capable of causing a coagulation reaction with at least a portion of the component included in the ink removed from the glue belt 117. Accordingly, by adding the pre-treatment agent PL to the cleaning liquid Q including the components contained in the ink removed from the glue belt 117, the ink component is coagulated so that settling of the ink component can be facilitated. Then, by coagulating at least a portion of the ink component by the pretreatment agent PL, it is possible to reduce an amount of ink component that is coagulated by the coagulating agent FL contained in the cleaning liquid Q. Accordingly, a use amount of coagulating agent FL can be reduced.

(6) The printing system 11 includes the stirring unit 265 configured to stir the cleaning liquid Q to which the coagulating agent FL is added in the coagulation tank 211. By stirring the cleaning liquid Q, the stirring unit 265 can make the concentration of the coagulating agent FL in the cleaning liquid Q in the coagulation tank 211 approximately uniform. Accordingly, the number of portions where the coagulation does not proceed because of the low concentration of the coagulating agent FL can be reduced. Further, by stirring the cleaning liquid Q, the stirring unit 265 can make the concentration of the ink component in the cleaning liquid Q in the coagulation tank 211 approximately uniform. Accordingly, the number of portions where coagulation does not proceed because of the high concentration of the ink component can be reduced. In this manner, by stirring the cleaning liquid Q, the concentration of the cleaning liquid Q can be made uniform so that the coagulation of the ink component is facilitated and hence, a large amount of ink component can be coagulated from the whole cleaning liquid Q using an appropriate amount of coagulating agent FL.

(7) The printing system 11 performs the coagulation operation where the coagulating agent FL is added to the cleaning liquid Q in the coagulation tank 211 so that the ink component is coagulated, and the cleaning operation in parallel. In the printing system 11, the coagulation operation is performed in the coagulation tank 211 that is disposed at a location remote from the glue belt 117. Accordingly, the coagulation operation can be performed without being affected by the state of the glue belt 117 that is cleaned in the cleaning operation. That is, the coagulation operation can be performed in parallel with the cleaning operation of the glue belt 117. In the printing system 11, by performing the coagulation operation in parallel with the cleaning operation, it is possible to suppress the lowering of productivity of the printing system 11 caused by stopping of the cleaning operation being affected by the coagulation operation or caused by stopping of the coagulation operation being affected by the cleaning operation.

(8) The printing system 11 performs the coagulation operation where the coagulating agent FL is added to the cleaning liquid Q in the coagulation tank 211 so that the ink component is coagulated, and the printing operation, in parallel. In the printing system 11, the coagulation operation is performed in the coagulation tank 211 that is disposed at a location remote from the glue belt 117. With such an operation, the coagulation operation can be performed without being affected by the state of the glue belt 117 that supports the medium M in the printing operation. That is, the coagulation operation can be performed in parallel with the printing operation that is performed by jetting a liquid to the medium M supported on the glue belt 117. In the printing system 11, by performing the coagulation operation in parallel with the printing operation that is performed by jetting the liquid to the medium M supported on the glue belt 117, it is possible to suppress the lowering of productivity of the printing system 11 caused by stopping of the printing operation being affected by the coagulation operation or caused by stopping of the coagulation operation being affected by the printing operation.

(9) The printing system 11 includes the supply flow path 231 configured to cause the coagulation tank 211 and the storage tank 134 to communicate with each other so that the cleaning liquid Q from which the coagulated material is separated is supplied to the storage tank 134 though the supply flow path 231. The supply flow path 231 is coupled to the coagulation tank 211 at the position below the liquid level located when the cleaning liquid Q is stored in the coagulation tank 211 and above the coagulation tank 211. The coagulated ink component that is produced by adding the coagulating agent FL to the cleaning liquid Q is liable to settle and hence, an amount of ink component on an upper side of the coagulation tank 211 is small. Accordingly, by coupling the supply flow path 231 to the coagulation tank 211 at the position below the liquid level located when the cleaning liquid Q is stored and above the coagulation tank 211, it is possible to suppress the ink component in the coagulation tank 211 from flowing out from the coagulation tank 211 into the supply flow path 231 extending toward the storage tank 134.

(10) The printing system 11 includes the second pump 233. The second pump 233 is disposed on the supply flow path 231, and is configured to transfer the cleaning liquid Q stored in the coagulation tank 211 to the storage tank 134 through the supply flow path 231. The second pump 233 is configured to transfer the cleaning liquid Q from the storage tank 134 to the coagulation tank 211 through the supply flow path 231. The second pump 233 is configured to remove the ink component from the separation unit by transferring the cleaning liquid Q from the storage tank 134 to the coagulation tank 211. When the second pump 233 transfers the cleaning liquid Q from the storage tank 134 to the coagulation tank 211 through the supply flow path 231, the cleaning liquid Q passes through the second filter 232 from a storage tank 134 side of the second filter 232 toward a coagulation tank 211 side of the second filter 232.

Accordingly, the ink component captured by the second filter 232 is pushed back toward the coagulation tank 211 side, and is separated from the second filter 232. That is, the ink component captured by the second filter 232 can be removed from the second filter 232.

For example, at a timing that a cumulative predetermined amount of cleaning liquid Q passes through the second filter 232 after starting the use of the printing system 11, the second pump 233 transfers the cleaning liquid Q from the storage tank 134 to the coagulation tank 211 through the supply flow path 231. Then, this operation is periodically performed. Accordingly, it is possible to extend the lifetime of the cleaning liquid Q until the cleaning liquid Q cannot pass through the second filter 232 any more.

For example, when the cleaning liquid Q cannot pass through the second filter 232 due to the ink component captured by the second filter 232, the operation of transferring the cleaning liquid Q stored in the coagulation tank 211 to the storage tank 134 is stopped. In such a case, since the cleaning liquid Q is transferred from the storage tank 134 to the coagulation tank 211 through the supply flow path 231, the ink component captured by the second filter 232 is removed from the second filter 232. Accordingly, it is possible to suppress the continuation of a state where the operation of transferring the cleaning liquid Q stored in the coagulation tank 211 to the storage tank 134 is stopped.

(11) The treatment apparatus 200 includes the collection flow path 221, the coagulation tank 211, the second filter 232, and the supply flow path 231. After the cleaning liquid Q is used in the cleaning operation of the glue belt 117 in the storage tank 134, the coagulating agent FL is added to the cleaning liquid Q, and the cleaning liquid Q is stored in the coagulation tank 211. The coagulated ink component that is produced by adding the coagulating agent FL to the cleaning liquid Q used in the cleaning operation is produced as a coagulated material. Further, when the cleaning liquid Q is supplied from the coagulation tank 211 to the storage tank 134 for reuse, the coagulated ink component in the cleaning liquid Q is separated from the cleaning liquid Q by the second filter 232. Then, the cleaning liquid Q is reused in the cleaning operation of the glue belt 117. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced.

(12) The treatment apparatus 200 includes the coagulating agent adding unit 212 configured to add the coagulating agent FL to the coagulation tank 211. The coagulating agent FL is added to the cleaning liquid Q in the coagulation tank 211 by the coagulating agent adding unit 212 and hence, it is possible for the user to eliminate the cumbersomeness that the user has to add the coagulating agent FL to the cleaning liquid in the coagulation tank 211.

(13) The treatment apparatus 200 includes the concentration measuring unit 250 configured to measure the concentration of the ink component contained in the cleaning liquid Q, and the coagulating agent adding unit 212 is configured to add the coagulating agent FL according to the concentration measured by the concentration measuring unit 250. By measuring the concentration of the ink component contained in the cleaning liquid Q, an amount of coagulating agent FL required for coagulating the ink component is calculated based on the measured concentration, and only the required amount of coagulating agent FL can be added to the cleaning liquid Q. Accordingly, the ink component contained in the cleaning liquid Q can be coagulated using an appropriate amount of coagulating agent FL.

(14) The treatment apparatus 200 includes the concentration estimation unit 291 configured to estimate the concentration of the ink component contained in the cleaning liquid Q based on a printing state of the medium M, and the coagulating agent adding unit 212 is configured to add the coagulating agent FL according to the concentration estimated by the concentration estimation unit 291. By estimating the concentration of the ink component contained in the cleaning liquid Q based on the printing state of the medium M, an amount of coagulating agent FL required for coagulating the ink component is calculated without using a dedicated concentration measurement sensor, and only the required amount of coagulating agent FL can be added to the cleaning liquid Q. Accordingly, the ink component contained in the cleaning liquid Q can be coagulated using an appropriate amount of coagulating agent FL while suppressing a cost of the treatment apparatus 200.

(15) The treatment apparatus 200 includes the stirring unit 265 configured to stir the cleaning liquid Q to which the coagulating agent FL is added in the coagulation tank 211. By stirring the cleaning liquid Q, the stirring unit 265 can make the concentration of the coagulating agent FL in the cleaning liquid Q in the coagulation tank 211 approximately uniform. Accordingly, the number of portions where the coagulation does not proceed because of the low concentration of the coagulating agent FL can be reduced. Further, by stirring the cleaning liquid Q, the stirring unit 265 can make the concentration of the ink component in the cleaning liquid Q in the coagulation tank 211 approximately uniform. Accordingly, the number of portions where coagulation does not proceed because of the high concentration of the ink component can be reduced. In this manner, by stirring the cleaning liquid Q, the concentration of the cleaning liquid Q can be made uniform so that the coagulation of the ink component is facilitated and hence, the cleaning liquid Q and the ink component can be separated from each other using an appropriate amount of coagulating agent FL.

(16) The treatment apparatus 200 is configured to perform the coagulation operation where the coagulating agent FL is added to the cleaning liquid Q in the coagulation tank 211 so that the ink component is coagulated, in parallel with the cleaning operation performed by the printing apparatus 100. In the treatment apparatus 200, the coagulation operation where the coagulating agent FL is added to the cleaning liquid Q so that the ink component is coagulated is performed in the coagulation tank 211 that is disposed at the location remote from the glue belt 117. Accordingly, the coagulation operation can be performed without being affected by the state of the glue belt 117 that is cleaned in the cleaning operation. That is, the coagulation operation can be performed in parallel with the cleaning operation of the glue belt 117. The treatment apparatus 200 performs the coagulation operation in parallel with the cleaning operation of the printing apparatus 100. Accordingly, it is possible to suppress the lowering of productivity of the printing apparatus 100 and the treatment apparatus 200 caused by stopping of the cleaning operation being affected by the coagulation operation or caused by stopping of the coagulation operation being affected by the cleaning operation.

(17) The treatment apparatus 200 is configured to perform the coagulation operation where the coagulating agent FL is added to the cleaning liquid Q in the coagulation tank 211 so that the ink component is coagulated, in parallel with the printing operation that is performed by the printing apparatus 100. In the treatment apparatus 200, the coagulation operation where the coagulating agent FL is added to the cleaning liquid Q so that the ink component is coagulated is performed in the coagulation tank 211 that is disposed at the location remote from the glue belt 117. Accordingly, the coagulation operation can be performed without being affected by the state of the glue belt 117 that supports the medium M in the printing operation. That is, the coagulation operation can be performed in parallel with the printing operation that is performed by jetting a liquid to the medium M supported on the glue belt 117. The treatment apparatus 200 performs the coagulation operation in parallel with the printing operation of the printing apparatus 100. Accordingly it is possible to suppress the lowering of productivity of the printing apparatus 100 and the treatment apparatus 200 caused by stopping of the printing operation being affected by the coagulation operation or caused by stopping of the coagulation operation being affected by the printing operation.

(18) In the treatment apparatus 200, the supply flow path 231 is coupled to the coagulation tank 211 at the position below the liquid level located when the cleaning liquid Q is stored in the coagulation tank 211 and above the coagulation tank 211. The ink component coagulated by adding the coagulating agent FL to the cleaning liquid Q is liable to settle and hence, an amount of ink component on an upper side of the coagulation tank 211 is small. Accordingly, by coupling the supply flow path 231 to the coagulation tank 211 at the position below the liquid level located when the cleaning liquid Q is stored and above the coagulation tank 211, it is possible to suppress the ink component in the coagulation tank 211 from flowing out from the coagulation tank 211 into the supply flow path 231 extending toward the storage tank 134.

(19) The printing system 11 includes the glue belt 117, the liquid jetting unit 120 configured to perform the printing operation by jetting ink onto the medium M, the storage tank 134 configured to store the cleaning liquid Q, and the cleaning brush 137 configured to perform the cleaning operation of the glue belt 117 using the cleaning liquid Q. The printing system 11 includes the coagulation tank 211 configured to store the cleaning liquid Q to which the coagulating agent FL is added, and the second filter 232. After the cleaning liquid Q is used in the cleaning operation of the glue belt 117 in the storage tank 134, the pre-treatment agent PL is added to the cleaning liquid Q, and the cleaning liquid Q is stored in the coagulation tank 211. The coagulated Ink component that is produced by adding the pre-treatment agent PL to the cleaning liquid Q used in the cleaning operation is produced as a coagulated material. Further, when the cleaning liquid Q is supplied from the coagulation tank 211 to the storage tank 134 for reuse, the coagulated ink component in the cleaning liquid Q is separated from the cleaning liquid Q by the second filter 232. Then, the cleaning liquid Q is reused in the cleaning operation of the glue belt 117. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced. Further, in the printing system 11, the pre-treatment agent PL added to the medium M to which the liquid is not yet jetted contains a component capable of causing a coagulation reaction with the components contained in the liquid jetted from the liquid jetting unit 120. Accordingly, the printing system 11 does not necessarily use a dedicated coagulating agent FL to reuse the cleaning liquid Q, and the pre-treatment agent PL added to the medium M to which the liquid is not yet jetted can also be used as the pre-treatment agent PL for coagulating the ink component.

(20) The method of reusing the cleaning liquid Q includes the step of performing the cleaning operation of the glue belt 117 using the cleaning liquid Q. The method of reusing the cleaning liquid Q includes, the step of adding the coagulating agent FL to the cleaning liquid Q used in the cleaning operation so that the coagulation is performed, and the step of separating the coagulated material that is produced by coagulation caused by adding the coagulating agent FL to the cleaning liquid Q from the cleaning liquid Q to which the coagulating agent FL is added. Further, the method of reusing the cleaning liquid Q includes the step of adding the pre-treatment agent PL to the cleaning liquid Q used in the cleaning operation so that the coagulation is performed, and the step of separating the coagulated ink component that is produced by adding the pre-treatment agent PL to the cleaning liquid Q from the cleaning liquid Q to which the pre-treatment agent PL is added. After the cleaning liquid Q is used in the cleaning operation of the glue belt 117 in the storage tank 134, the coagulating agent FL and the pre-treatment agent PL are added to the cleaning liquid Q, and the cleaning liquid Q is stored in the coagulation tank 211. Further, when the cleaning liquid Q is supplied from the coagulation tank 211 to the storage tank 134 for reuse, the coagulated ink component that is produced by adding the coagulating agent FL and the pre-treatment agent PL to the cleaning liquid Q used in the cleaning operation is separated from the cleaning liquid Q by the second filter 232. Then, the cleaning liquid Q is reused in the cleaning operation of the glue belt 117. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced.

The present embodiment described above may be modified as follows. The present embodiment and modifications thereof to be described below may be implemented in combination within a range in which a technical contradiction does not arise.

The printing system 11 may not include the collection flow path 221 configured to collect the cleaning liquid Q from the storage tank 134 to the coagulation tank 211, and the cleaning liquid Q may be collected by the user from the storage tank 134 to the coagulation tank 211.

The printing system 11 may not include the supply flow path 231 configured to supply the cleaning liquid Q from the coagulation tank 211 to the storage tank 134, and the cleaning liquid Q that is stored in the coagulation tank 211 and to which the coagulating agent FL is added may be allowed to pass through the second filter 232 and supplied to the storage tank 134, by a user.

The first pump 223, the second pump 233, the third pump 283, and the waste liquid pump 153 may be formed of an open/close valve respectively. There may be adopted a configuration where, when the open/close valve is opened, the liquid in the flow path is transferred through the open/close valve due to the water head pressure.

The first filter 222 may be provided at all coupling portions between the storage tank 134 and the collection flow path 221. Further, the first filter 222 may be provided at a coupling portion between the collection flow path 221 and the coagulation tank 211. At any position, the first filter 222 can separate a coagulated material.

The second filter 232 may be provided at a coupling portion between the coagulation tank 211 and the supply flow path 231. Further, the second filter 232 may be provided at a coupling portion between the supply flow path 231 and the storage tank 134. At any position, the second filter 232 can separate the coagulated material.

Hereinafter, technical concepts, and manner of operations and advantageous effects that are understood and acquired from the above-described embodiment and the modifications are described.

(A) A printing system includes: a transporting belt configured to support and transport a medium, a liquid jetting unit configured to perform a printing operation by jetting a liquid to the medium, a cleaning liquid storage unit configured to store a cleaning liquid, a cleaning unit configured to perform a cleaning operation of the transporting belt using the cleaning liquid stored in the cleaning liquid storage unit, a coagulation tank configured to store the cleaning liquid to which a coagulating agent is added after the cleaning liquid is used in the cleaning operation, and a separation unit configured to separate a coagulated material, produced by coagulation caused by adding the coagulating agent to the cleaning liquid, from the cleaning liquid, wherein the cleaning liquid from which the coagulated material is separated by the separation unit is supplied to the cleaning liquid storage unit.

According to such a configuration, after the cleaning liquid is used in the cleaning operation of the transporting belt in the cleaning liquid storage unit, the coagulating agent is added to the cleaning liquid, and the cleaning liquid is stored in the coagulation tank. The coagulated material that is produced by coagulation caused by adding the coagulating agent to the cleaning liquid used in the cleaning operation is produced. Then, when the cleaning liquid is supplied from the coagulation tank to the cleaning liquid storage unit for reuse, the coagulated material in the cleaning liquid is separated from the cleaning liquid by the separation unit. Then, the cleaning liquid is reused in the cleaning operation of the transporting belt. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced.

(B) The printing system described above may include a coagulating agent adding unit configured to add the coagulating agent to the cleaning liquid in the coagulation tank.

According to such a configuration, the coagulating agent is added to the cleaning liquid in the coagulation tank by the coagulating agent adding unit and hence, it is possible for the user to eliminate the cumbersomeness that the user has to add the coagulating agent to the cleaning liquid in the coagulation tank.

(C) In the printing system described above, the liquid is an ink, the coagulated material includes at least a portion of an ink component, and the printing system may include a concentration measuring unit configured to measure a concentration of the ink component contained in the cleaning liquid, and the coagulating agent adding unit may be configured to add the coagulating agent according to a concentration of the ink component measured by the concentration measuring unit.

According to such a configuration, by measuring the concentration of the ink component contained in the cleaning liquid, an amount of coagulating agent required for coagulating the ink component is calculated based on the measured concentration, and only the required amount of coagulating agent can be added to the cleaning liquid.

Accordingly, the ink component contained in the cleaning liquid can be coagulated using an appropriate amount of coagulating agent.

(D) In the printing system described above, the liquid is an ink, the coagulated material includes at least a portion of an ink component, and the printing system may include a concentration estimation unit configured to estimate a concentration of the ink component contained in the cleaning liquid based on a printing state of the medium, and the coagulating agent adding unit may be configured to add the coagulating agent according to a concentration of the ink component measured by the concentration estimation unit.

According to such a configuration, by estimating the concentration of the ink component included in the cleaning liquid based on the printing state of the medium, an amount of coagulating agent required for coagulating the ink component is calculated without using a dedicated concentration measurement sensor, and only the required amount of coagulating agent can be added to the cleaning liquid. Accordingly, the ink component contained in the cleaning liquid can be coagulated using an appropriate amount of coagulating agent while suppressing a cost of the printing system.

(E) In the printing system described above, the printing system may include a pre-treatment agent adding unit configured to add a pre-treatment agent to the medium to which the liquid is not yet jetted by the liquid jetting unit, and the pre-treatment agent adding unit may be configured to add a pre-treatment agent to at least one of the cleaning liquid in the cleaning liquid storage unit and the cleaning liquid in the coagulation tank.

According to such a configuration, the pre-treatment agent contains a component capable of causing a coagulation reaction with at least a portion of components contained in the liquid jetted from the liquid jetting unit That is, the pre-treatment agent contains a component capable of causing a coagulation reaction with at least a portion of the components contained in the liquid removed from the transporting belt. Accordingly, by adding the pre-treatment agent to the cleaning liquid including the liquid removed from the transporting belt, the component contained in the liquid is coagulated so that settling of the component can be facilitated. Then, by coagulating at least a portion of the components contained in the liquid by the pre-treatment agent, it is possible to reduce an amount of component to be coagulated by the coagulating agent contained in the cleaning liquid. Accordingly, a use amount of coagulating agent can be reduced.

(F) In the printing system described above, the printing unit may include a stirring unit configured to stir the cleaning liquid to which the coagulating agent is added in the coagulation tank.

According to such a configuration, by stirring the cleaning liquid, the stirring unit can make the concentration of the coagulating agent in the cleaning liquid in the coagulation tank approximately uniform. Accordingly, the number of portions where the coagulation does not proceed because of the low concentration of the coagulating agent can be reduced. Further, by stirring the cleaning liquid, the stirring unit can make the concentration of the coagulated material in the cleaning liquid in the coagulation tank approximately uniform. Accordingly, the number of portions where the coagulation does not proceed because of the high concentration of the coagulating agent can be reduced. In this manner, by stirring the cleaning liquid, the concentration of the cleaning liquid can be made uniform so that the coagulation of the coagulated material is facilitated and hence, a large amount of coagulated material can be coagulated from the whole cleaning liquid using an appropriate amount of coagulating agent.

(G) In the printing system described above, a coagulation operation where the coagulating agent is added to the cleaning liquid in the coagulation tank so that the coagulated material is produced by coagulation and the cleaning operation may be performed in parallel.

According to such a configuration, in the printing system, the coagulation operation where the coagulating agent is added to the cleaning liquid so that the coagulated material is produced by coagulation is performed in the coagulation tank that is disposed at a location remote from the transporting belt. Accordingly, the coagulation operation can be performed without being affected by the state of the transporting belt that is cleaned in the cleaning operation. That is, the coagulation operation can be performed in parallel with the cleaning operation of the transporting belt. In the printing system, by performing the coagulation operation in parallel with the cleaning operation, it is possible to suppress the lowering of productivity of the printing system caused by stopping of the cleaning operation being affected by the coagulation operation or caused by stopping of the coagulation operation being affected by the cleaning operation.

(H) In the printing system described above, the coagulation operation where the coagulating agent is added to the cleaning liquid in the coagulation tank so that the coagulated material is produced by coagulation and the printing operation may be performed in parallel.

According to such a configuration, in the printing system, the coagulation operation where the coagulating agent is added to the cleaning liquid so that the coagulation of the coagulated material is performed is performed in the coagulation tank that is disposed at a location remote from the transporting belt. Accordingly, the coagulation operation can be performed without being affected by the state of the transporting belt that supports the medium in the printing operation. That is, the coagulation operation can be performed in parallel with the printing operation that is performed by jetting the liquid to the medium supported on the transporting belt. In the printing system, by performing the coagulation operation in parallel with the printing operation that is performed by jetting the liquid to the medium supported on the transporting belt, it is possible to suppress the lowering of productivity of the printing system caused by stopping of the printing operation being affected by the coagulation operation or caused by stopping of the coagulation operation being affected by the printing operation.

(I) The printing system described above may include a supply flow path that is configured to cause the coagulation tank and the cleaning liquid storage unit to communicate with each other thus supplying the cleaning liquid from which the coagulated material is separated to the cleaning liquid storage unit, and the supply flow path may be coupled to the coagulation tank at a position below a liquid level of the cleaning liquid when the cleaning liquid is stored in the coagulation tank and above the coagulation tank.

According to such a configuration, the coagulated material that is produced by coagulation caused by adding the coagulating agent to the cleaning liquid is liable to settle and hence, an amount of the coagulated material on the upper side of the coagulation tank is small. Accordingly, by coupling the supply flow path to the coagulation tank at the position below the liquid level located when the cleaning liquid is stored and above the coagulation tank, it is possible to suppress the coagulated material in the coagulation tank from flowing out from the coagulation tank into the supply flow path extending toward the cleaning liquid storage unit.

(J) In the printing system described above, the printing system may include a supply flow path that is configured to cause the coagulation tank and the cleaning liquid storage unit to communicate with each other thus supplying the cleaning liquid from which the coagulated material is separated to the cleaning liquid storage unit, and a pump that is disposed on the supply flow path and is configured to transfer the cleaning liquid stored in the coagulation tank to the cleaning liquid storage unit in the supply flow path. The pump may be configured to transfer the cleaning liquid from the cleaning liquid storage unit to the coagulation tank in the supply flow path, and the coagulated material may be separated from the separation unit by transferring the cleaning liquid from the cleaning liquid storage unit to the coagulation tank.

According to such a configuration, the pump transfers the cleaning liquid from the cleaning liquid storage unit to the coagulation tank in the supply flow path. At this stage of the operation, the cleaning liquid passes through the separation unit from the cleaning liquid storage unit side of the separation unit toward the coagulation tank side of the separation unit. Accordingly, the coagulated material captured by the separation unit is pushed back toward the coagulation tank side and is separated from the separation unit. That is, the coagulated material captured by the separation unit can be removed from the separation unit.

For example, at a timing that a cumulative predetermined amount of cleaning liquid passes through the separation unit after starting the use of the printing system, the pump transfers the cleaning liquid from the cleaning liquid storage unit to the coagulation tank through the supply flow path. Then, this operation is periodically performed.

Accordingly, it is possible to extend the lifetime of the cleaning liquid until the cleaning liquid cannot pass through the separation unit any more.

For example, when the cleaning liquid cannot pass through the separation unit due to the coagulated material captured by the separation unit, the operation of transferring the cleaning liquid stored in the coagulation tank to the cleaning liquid storage unit is stopped. In such a case, since the cleaning liquid is transferred from the cleaning liquid storage unit to the coagulation tank through the supply flow path, the coagulated material captured by the separation unit is removed from the separation unit. Accordingly, it is possible to suppress the continuation of a state where the operation of transferring the cleaning liquid stored in the coagulation tank to the cleaning liquid storage unit is stopped.

(K) A treatment apparatus is a treatment apparatus for a printing apparatus that includes: a transporting belt configured to support and transport a medium, a liquid jetting unit configured to perform a printing operation by jetting a liquid to the medium, and a cleaning unit configured to perform a cleaning operation of the transporting belt, the treatment apparatus being configured to treat a cleaning liquid used in the cleaning operation of the transporting belt, wherein the treatment apparatus includes: a collection flow path configured to collect the cleaning liquid used in the cleaning operation from the printing apparatus, a coagulation tank configured to store the cleaning liquid collected from the printing apparatus by the collection flow path and to which a coagulating agent is added after the cleaning liquid is used in the cleaning operation, a separation unit configured to separate a coagulated material, produced by coagulation caused by adding the coagulating agent to the cleaning liquid, from the cleaning liquid, and a supply flow path configured to supply the cleaning liquid from which the coagulated material is separated by the separation unit to the printing apparatus.

According to such a configuration, after the cleaning liquid is used in the cleaning operation of the transporting belt in the cleaning liquid storage unit, the coagulating agent is added to the cleaning liquid, and the cleaning liquid is stored in the coagulating tank. The coagulated material that is produced by coagulation caused by adding the coagulating agent to the cleaning liquid used in the cleaning operation is produced. Then, when the cleaning liquid is supplied from the coagulation tank to the cleaning liquid storage unit for reuse, the coagulated material in the cleaning liquid is separated from the cleaning liquid by the separation unit. Then, the cleaning liquid is reused in the cleaning operation of the transporting belt. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced.

(L) The printing apparatus described above may include a coagulating agent adding unit configured to add the coagulating agent to the coagulation tank.

According to such a configuration, the coagulating agent is added to the cleaning liquid in the coagulation tank by the coagulating agent adding unit and hence, it is possible for the user to eliminate the cumbersomeness that the user has to add the coagulating agent to the cleaning liquid in the coagulation tank.

(M) In the treatment apparatus described above, the liquid is an ink, the coagulated material includes at least a portion of an ink component. The treatment apparatus may include a concentration measuring unit configured to measure a concentration of the ink component contained in the cleaning liquid, and the coagulating agent adding unit may be configured to add the coagulating agent according to the concentration measured by the concentration measuring unit.

According to such a configuration, by measuring the concentration of the ink component contained in the cleaning liquid, an amount of coagulating agent required for coagulating the ink component is calculated based on the measured concentration, and only the required amount of coagulating agent can be added to the cleaning liquid. Accordingly, the ink component contained in the cleaning liquid can be coagulated using an appropriate amount of coagulating agent.

(N) In the treatment apparatus described above, the liquid is an ink, the coagulated material includes at least a portion of an ink component. The treatment apparatus may include a concentration estimation unit configured to estimate a concentration of the ink component contained in the cleaning liquid based on a printing state of the medium, and the coagulating agent adding unit may be configured to add the coagulating agent according to the concentration estimated by the concentration estimation unit.

According to such a configuration, by estimating the concentration of the ink component contained in the cleaning liquid based on the printing state of the medium, an amount of coagulating agent required for coagulating the ink component is calculated without using a dedicated concentration measurement sensor, and only the required amount of coagulating agent can be added to the cleaning liquid. Accordingly, the ink component contained in the cleaning liquid can be coagulated using an appropriate amount of coagulating agent while suppressing a cost of the treatment apparatus.

(0) In the treatment apparatus described above, the treatment apparatus may include a stirring unit configured to stir the cleaning liquid to which the coagulating agent is added in the coagulation tank.

According to such a configuration, by stirring the cleaning liquid, the stirring unit can make the concentration of the coagulating agent in the cleaning liquid in the coagulation tank approximately uniform. Accordingly, the number of portions where the coagulation does not proceed because of the low concentration of the coagulating agent can be reduced. Further, by stirring the cleaning liquid, the stirring unit can make the concentration of the coagulated material in the cleaning liquid in the coagulation tank approximately uniform. Accordingly, the number of portions where the coagulation does not proceed because of the high concentration of the coagulating agent can be reduced. In this manner, by stirring the cleaning liquid, the concentration of the cleaning liquid can be made uniform so that the coagulation of the coagulated material is facilitated and hence, the cleaning liquid and the coagulated material can be separated from each other using an appropriate amount of coagulating agent.

(P) In the treatment apparatus described above, a coagulation operation where the coagulating agent is added to the cleaning liquid in the coagulation tank so that the coagulated material is produced by coagulation may be performed in parallel with the cleaning operation performed by the printing apparatus.

According to such a configuration, in the treatment apparatus, the coagulation operation where the coagulating agent is added to the cleaning liquid so that the coagulated material is produced by coagulation is performed in the coagulation tank that is disposed at a location remote from the transporting belt. Accordingly, the coagulation operation can be performed without being affected by the state of the transporting belt that is cleaned in the cleaning operation. That is, the coagulation operation can be performed in parallel with the cleaning operation of the transporting belt. The treatment apparatus performs the coagulation operation in parallel with the cleaning operation of the printing apparatus. Accordingly, it is possible to suppress the lowering of productivity of the printing apparatus and the treatment apparatus caused by stopping of the cleaning operation being affected by the coagulation operation or caused by stopping of the coagulation operation being affected by the cleaning operation.

(Q) In the treatment apparatus described above, a coagulation operation where the coagulating agent is added to the cleaning liquid in the coagulation tank so that the coagulated material is produced by coagulation may be performed in parallel with the printing operation performed by the printing apparatus.

According to such a configuration, in the treatment apparatus, the coagulation operation where the coagulating agent is added to the cleaning liquid so that the coagulation of the coagulated material is performed is performed in the coagulation tank that is disposed at a location remote from the transporting belt. Accordingly, the coagulation operation can be performed without being affected by the state of the transporting belt that supports the medium in the printing operation. That is, the coagulation operation can be performed in parallel with the printing operation that is performed by jetting the liquid to the medium supported on the transporting belt. The treatment apparatus performs the coagulation operation in parallel with the printing operation of the printing apparatus. Accordingly it is possible to suppress the lowering of productivity of the printing apparatus and the treatment apparatus caused by stopping of the printing operation being affected by the coagulation operation or caused by stopping of the coagulation operation being affected by the printing operation.

(R) In the treatment apparatus described above, the supply flow path is coupled to the coagulation tank at the position below the liquid level located when the cleaning liquid is stored in the coagulation tank and above the coagulation tank.

According to such a configuration, the coagulated material that is produced by coagulation caused by adding the coagulating agent to the cleaning liquid is liable to settle and hence, an amount of the coagulated material on the upper side of the coagulation tank is small. Accordingly, by coupling the supply flow path to the coagulation tank at the position below the liquid level located when the cleaning liquid is stored and above the coagulation tank, it is possible to suppress the coagulated material in the coagulation tank from flowing out from the coagulation tank into the supply flow path extending toward the cleaning liquid storage unit.

(S) A printing system includes: a transporting belt configured to support and transport a medium, a liquid jetting unit configured to perform a printing operation by jetting a liquid to the medium, a cleaning liquid storage unit configured to store the cleaning liquid, a cleaning unit configured to perform a cleaning operation of the transporting belt using the cleaning liquid stored in the cleaning liquid storage unit, a coagulation tank configured to store the cleaning liquid to which a pre-treatment agent is added after the cleaning liquid is used in the cleaning operation, and a separation unit configured to separate a coagulated material, produced by coagulation caused by adding the pre-treatment agent to the cleaning liquid, from the cleaning liquid, wherein the cleaning liquid from which the coagulated material is separated by the separation unit is supplied to the cleaning liquid storage unit.

According to such a configuration, after the cleaning liquid is used in the cleaning operation of the transporting belt in the cleaning liquid storage unit, the pre-treatment agent is added to the cleaning liquid, and the cleaning liquid is stored in the coagulation tank. The coagulated material that is produced by coagulation caused by adding the pre-treatment agent to the cleaning liquid used in the cleaning operation is produced. Then, when the cleaning liquid is supplied from the coagulation tank to the cleaning liquid storage unit for reuse, the coagulated material in the cleaning liquid is separated from the cleaning liquid by the separation unit. Then, the cleaning liquid is reused in the cleaning operation of the transporting belt. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced. Further, in the printing system, the pre-treatment agent added to the medium to which the liquid is not yet jetted contains a component capable of causing a coagulation reaction with the component contained in the liquid jetted from the liquid jetting unit. Accordingly, the printing system may not necessarily use a dedicated coagulating agent to reuse the cleaning liquid, and the pre-treatment agent added to the medium to which the liquid is not yet jetted can also be used as the pre-treatment agent for coagulating the coagulated material.

(T) A method of reusing a cleaning liquid is a method of reusing a cleaning liquid in a printing system that includes: a transporting belt configured to support and transport a medium, a liquid jetting unit configured to perform a printing operation by jetting a liquid to the medium, a cleaning liquid storage unit configured to store the cleaning liquid, a cleaning unit configured to perform a cleaning operation of the transporting belt using the cleaning liquid stored in the cleaning liquid storage unit, a coagulation tank configured to store the cleaning liquid to which a coagulating agent is added after the cleaning liquid is used in the cleaning operation, and a separation unit configured to separate a coagulated material, produced by coagulation caused by adding the coagulating agent to the cleaning liquid, from the cleaning liquid, wherein the method including: performing the cleaning operation of the transporting belt using the cleaning liquid, performing coagulation by adding the coagulating agent to the cleaning liquid used in the cleaning operation, separating the coagulated material, produced by coagulation caused by adding the coagulating agent to the cleaning liquid, from the cleaning liquid to which the coagulating agent is added, performing coagulation by adding the pre-treatment agent to the cleaning liquid used in the cleaning operation, and separating the coagulated material, produced by coagulation caused by adding the pre-treatment agent to the cleaning liquid, from the cleaning liquid to which the pre-treatment agent is added.

According to such a configuration, after the cleaning liquid is used in the cleaning operation of the transporting belt in the cleaning liquid storage unit, the coagulating agent and the pre-treatment agent are added to the cleaning liquid, and the cleaning liquid is stored in the coagulation tank. Further, when the cleaning liquid is supplied from the coagulation tank to the cleaning liquid storage unit for reuse, the coagulated material that is produced by coagulation caused by adding the coagulating agent and the pre-treatment agent to the cleaning liquid used in the cleaning operation is separated from the cleaning liquid by the separation unit. Then, the cleaning liquid is reused in the cleaning operation of the transporting belt. Accordingly, in an installation such as an office that does not have a waste liquid treatment facility, it is possible for a user to eliminate cumbersomeness brought about by suitably collecting a waste liquid and by asking a waste liquid treatment dealer to treat the collected waste liquid. On the other hand, in an installation such as a factory that has a waste liquid treatment facility, electric power necessary for operating a dedicated waste liquid treatment facility can be largely reduced.

What is claimed is:

1. A printing system comprising:

a transporting belt configured to support and transport a medium;

a liquid jetting unit configured to perform a printing operation by jetting a liquid to the medium;

a cleaning liquid storage unit configured to store a cleaning liquid;

a cleaning unit configured to perform a cleaning operation of the transporting belt using the cleaning liquid stored in the cleaning liquid storage unit;

a coagulation tank configured to store the cleaning liquid used for cleaning operation and to which a coagulating agent is added; and a separation unit configured to separate the coagulated material, produced by coagulation caused by adding the coagulating agent to the cleaning liquid, from the cleaning liquid, wherein the cleaning liquid from which the coagulated material is separated by the separation unit is supplied to the cleaning liquid storage unit.

2. The printing system according to claim 1, comprising a coagulating agent adding unit configured to add the coagulating agent to the cleaning liquid in the coagulation tank.

3. The printing system according to claim 2, wherein the liquid is ink and the coagulated material contains at least a portion of an ink component, the printing system comprises a concentration measuring unit configured to measure a concentration of the ink component contained in the cleaning liquid, the coagulating agent adding unit is configured to add the coagulating agent according to the concentration measured by the concentration measuring unit.

4. The printing system according to claim 2, wherein the liquid is ink and the coagulated material contains at least a portion of an ink component, the printing system comprises a concentration estimation unit configured to estimate a concentration of the ink component contained in the cleaning liquid based on a printing state of the medium, and the coagulating agent adding unit is configured to add the coagulating agent according to the concentration estimated by the concentration estimation unit.

5. The printing system according to claim 1, comprising a pre-treatment agent adding unit configured to add a pre-treatment agent to the medium to which the liquid is not yet jetted by the liquid jetting unit, wherein the pre-treatment agent adding unit is configured to add a pretreatment agent to at least one of the cleaning liquid in the cleaning liquid storage unit and the cleaning liquid in the coagulation tank.

6. The printing system according to claim 1, comprising a stirring unit configured to stir the cleaning liquid to which the coagulating agent is added in the coagulation tank.

7. The printing system according to claim 1, wherein a coagulation operation where the coagulating agent is added to the cleaning liquid in the coagulation tank so that the coagulated material is produced by coagulation, and the cleaning operation are performed in parallel.

8. The printing system according to claim 1, wherein the coagulation operation where the coagulating agent is added to the cleaning liquid in the coagulation tank so that the coagulated material is produced by coagulation, and the printing operation are performed in parallel.

9. The printing system according to claim 1, comprising a supply flow path configured to cause the coagulation tank and the cleaning liquid storage unit to communicate with each other, and configured to supply the cleaning liquid from which the coagulated material is separated to the cleaning liquid storage unit, wherein the supply flow path is coupled to the coagulation tank at a position below a liquid level located when the cleaning liquid is stored in the coagulation tank and above the coagulation tank.

10. The printing system according to claim 1, comprising:

a supply flow path configured to cause the coagulation tank and the cleaning liquid storage unit to communicate with each other, and configured to supply the cleaning liquid from which the coagulated material is separated to the cleaning liquid storage unit; and a pump disposed on the supply flow path, and configured to transfer the cleaning liquid stored in the coagulation tank to the cleaning liquid storage unit in the supply flow path, wherein the pump is configured to transfer the cleaning liquid from the cleaning liquid storage unit to the coagulation tank in the supply flow path, and configured to remove the coagulated material from the separation unit by transferring the cleaning liquid from the cleaning liquid storage unit to the coagulation tank.

11. A method of reusing a cleaning liquid in a printing system that includes: a transporting belt configured to support and transport a medium; a liquid jetting unit configured to perform a printing operation by jetting a liquid to the medium; a cleaning liquid storage unit configured to store a cleaning liquid; a cleaning unit configured to perform a cleaning operation of the transporting belt using the cleaning liquid stored in the cleaning liquid storage unit; a coagulation tank configured to store the cleaning liquid used for cleaning operation and to which a coagulating agent is added; and a separation unit configured to separate, from the cleaning liquid, a coagulated material that is produced by coagulation caused by adding the coagulating agent to the cleaning liquid, wherein the method comprising:

performing a cleaning operation of the transporting belt using the cleaning liquid;

performing coagulation by adding a coagulating agent to the cleaning liquid used in the cleaning operation;

separating a coagulated material, produced by coagulation caused by adding the coagulating agent to the cleaning liquid, from the cleaning liquid to which the coagulating agent is added;

performing coagulation by adding a pre-treatment agent to the cleaning liquid used in the cleaning operation; and separating a coagulated material, produced by coagulation caused by adding the pre-treatment agent to the cleaning liquid, from the cleaning liquid to which the pre-treatment agent is added.

* * * * *